US011654682B2

(12) United States Patent
Hayashi

(10) Patent No.: US 11,654,682 B2
(45) Date of Patent: May 23, 2023

(54) LIQUID DISCHARGE HEAD

(71) Applicant: Brother Kogyo Kabushiki Kaisha, Nagoya (JP)

(72) Inventor: Hideki Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/494,354

(22) Filed: Oct. 5, 2021

(65) Prior Publication Data

US 2022/0024209 A1 Jan. 27, 2022

Related U.S. Application Data

(63) Continuation of application No. 16/561,364, filed on Sep. 5, 2019, now Pat. No. 11,155,091, which is a (Continued)

(30) Foreign Application Priority Data

Mar. 31, 2015 (JP) ..... 2015-074356

(51) Int. Cl.
*B41J 2/14* (2006.01)

(52) U.S. Cl.
CPC ..... *B41J 2/1433* (2013.01); *B41J 2/14233* (2013.01); *B41J 2002/14419* (2013.01)

(58) Field of Classification Search
CPC ..... B41J 2/14; B41J 2/14145; B41J 2/14201; B41J 2/14274; B41J 2/14233; B41J 2/1433; B41J 2002/14419; B41J 2002/14306
See application file for complete search history.

(56) References Cited

U.S. PATENT DOCUMENTS 6,508,546 B2 1/2003 Silverbrook
6,644,793 B2 11/2003 Silverbrook
(Continued)

FOREIGN PATENT DOCUMENTS

CN 1578732 A 2/2005
CN 1654215 A 8/2005
(Continued)

OTHER PUBLICATIONS

Sep. 15, 2016—(EP) Extended European Search Report—App 16162373.1.
(Continued)

*Primary Examiner* — Scott A Richmond
(74) *Attorney, Agent, or Firm* — Banner & Witcoff, Ltd.

(57) ABSTRACT

A liquid discharge apparatus includes an individual flow passage member; and a common flow passage member joined to the individual flow passage member in a first direction. The individual flow passage member has nozzle groups formed on a surface on a side opposite to the common flow passage member and connecting hole groups formed on a surface on a side of the common flow passage member; and the common flow passage member has manifold flow passages corresponding to the connecting hole groups respectively. Each of the nozzle groups includes nozzles aligned in a second direction orthogonal to the first direction; and each of the connecting hole groups includes connecting holes aligned in the second direction and connected to the nozzles respectively. Each of the manifold flow passages extends in the second direction and is connected to the nozzles via the connecting holes.

15 Claims, 22 Drawing Sheets

Related U.S. Application Data continuation of application No. 15/849,766, filed on Dec. 21, 2017, now Pat. No. 10,442,199, which is a continuation of application No. 15/080,852, filed on Mar. 25, 2016, now Pat. No. 9,878,539.

(56) References Cited

U.S. PATENT DOCUMENTS

| | | | | |
|---|---|---|---|---|
| 6,652,082 | B2 | 11/2003 | Silverbrook | |
| 6,715,861 | B2 | 4/2004 | Sakamoto et al. | |
| 7,070,256 | B2 | 7/2006 | Silverbrook | |
| 7,380,905 | B1 | 6/2008 | Silverbrook | |
| 7,556,352 | B2 | 7/2009 | Silverbrook | |
| 7,654,643 | B2 | 2/2010 | Silverbrook | |
| 7,984,968 | B2 | 7/2011 | Silverbrook | |
| 2002/0024569 | A1 | 2/2002 | Silverbrook | |
| 2002/0149652 | A1 | 10/2002 | Sakamoto et al. | |
| 2003/0020786 | A1 | 1/2003 | Silverbrook | |
| 2003/0137567 | A1 | 7/2003 | Silverbrook | |
| 2003/0142175 | A1 | 7/2003 | Silverbrook | |
| 2004/0066430 | A1 | 4/2004 | Sekiguchi | |
| 2004/0207687 | A1 | 10/2004 | Silverbrook | |
| 2007/0285472 | A1* | 12/2007 | Hara | B41J 2/14209 347/68 |
| 2008/0239005 | A1 | 10/2008 | Silverbrook | |
| 2009/0102907 | A1 | 4/2009 | Yamanaka et al. | |
| 2010/0045754 | A1 | 2/2010 | Stephens et al. | |
| 2010/0097430 | A1 | 4/2010 | Silverbrook | |
| 2010/0271445 | A1 | 10/2010 | Sharan et al. | |
| 2012/0081438 | A1 | 4/2012 | Shimizu | |
| 2012/0236085 | A1* | 9/2012 | Miyata | B41J 2/164 347/71 |
| 2013/0033550 | A1 | 2/2013 | Kobayashi | |
| 2013/0106954 | A1 | 5/2013 | Choy et al. | |
| 2013/0127956 | A1 | 5/2013 | Watanabe et al. | |
| 2013/0182041 | A1 | 7/2013 | Tanaka et al. | |
| 2014/0043388 | A1 | 2/2014 | Yoshimura et al. | |
| 2014/0063132 | A1* | 3/2014 | Scheffelin | B41J 2/14233 347/71 |
| 2015/0002582 | A1 | 1/2015 | McKinnell et al. | |
| 2015/0138282 | A1 | 5/2015 | Kobayashi et al. | |

FOREIGN PATENT DOCUMENTS

| | | | |
|---|---|---|---|
| CN | 102470671 | A | 5/2012 |
| JP | 2005-161633 | A | 6/2005 |
| JP | 2006-088648 | A | 4/2006 |
| JP | 2007-307774 | A | 11/2007 |
| JP | 2007-531645 | A | 11/2007 |
| JP | 2007307774 | A | 11/2007 |
| JP | 2008-023202 | A | 2/2008 |
| JP | 2008-230202 | A | 10/2008 |
| JP | 2013-028033 | A | 2/2013 |
| JP | 2013-119166 | A | 6/2013 |
| JP | 2014054796 | A | 3/2014 |
| JP | 2014-162189 | A | 9/2014 |
| JP | 2014-172352 | A | 9/2014 |
| JP | 2014-195929 | A | 10/2014 |
| WO | 01-042024 | A1 | 6/2001 |
| WO | 01/89849 | A1 | 11/2001 |
| WO | 2005/097506 | A2 | 10/2005 |
| WO | 2011/011807 | A1 | 2/2011 |

OTHER PUBLICATIONS

Jul. 31, 2018—(JP) Notice of Reasons for Rejection—App 2015-074356.
Oct. 29, 2018—(EP) Office Action—App 16162373.1.
Nov. 2, 2018—(CN) Notification of First Office Action—App 201610169742.6.
Jan. 10, 2020—(EP) Extended Search Report—App 19198999.5.
Dec. 23, 2016—(US) Non-Final Office Action—U.S. Appl. No. 15/080,852.
Jun. 16, 2017—(US) Final Office Action—U.S. Appl. No. 15/080,852.
Oct. 10, 2017—(US) Notice of Allowance—U.S. Appl. No. 15/080,852.
Dec. 28, 2018—(US) Non-Final Office Action—U.S. Appl. No. 15/849,766.
Jun. 5, 2019—(US) Notice of Allowance—U.S. Appl. No. 15/849,766.
Jan. 29, 2021—(US) Non-Final Office Action—U.S. Appl. No. 16/561,364.
Apr. 22, 2021—(US) Notice of Allowance—U.S. Appl. No. 16/561,364.
Jul. 19, 2021—(US) Notice of Allowance—U.S. Appl. No. 16/561,364.
Sep. 27, 2022—(JP) Notice of Reasons for Refusal—App 2021-136109.

* cited by examiner

LIQUID DISCHARGE HEAD

CROSS REFERENCE TO RELATED APPLICATION

The present application is a continuation of U.S. patent application Ser. No. 16/561,364 filed Sep. 5, 2019, which is a continuation of U.S. patent application Ser. No. 15/849,766 filed Dec. 21, 2017, issued as U.S. Pat. No. 10,442,199 on Oct. 15, 2019, which is a continuation of U.S. patent application Ser. No. 15/080,852 filed Mar. 25, 2016, issued as U.S. Pat. No. 9,878,539 on Jan. 30, 2018, which claims priority from Japanese Patent Application No. 2015-074356 filed on Mar. 31, 2015, the disclosures of which are incorporated herein by reference in their entirety.

BACKGROUND

Field of the Invention

The present invention relates to a liquid discharge apparatus which discharges liquid from nozzles, and a liquid discharge apparatus unit.

Description of the Related Art

In the case of an ink-jet head described in Japanese Patent Application Laid-open No. 2014-195929, nozzle arrays, each of which is formed by aligning a plurality of nozzles in a transport direction, are arranged in four arrays in a scanning direction. Further, manifold flow passages, which extend in the transport direction, are arranged in the scanning direction between the first nozzle array and the second nozzle array as counted from the left side and between the first nozzle array and the second nozzle array as counted from the right side, respectively.

SUMMARY

In this context, as described above, the ink-jet head as described in Japanese Patent Application Laid-open No. 2014-195929 has such a structure that the manifold flow passage is arranged between the two nozzle arrays in the scanning direction. On the other hand, in the case of the ink-jet head described in Japanese Patent Application Laid-open No. 2014-195929, in order that the pressure wave, which is generated in a pressure chamber when a piezoelectric actuator is driven and which is transmitted to the manifold flow passage, is sufficiently attenuated in the manifold flow passage, it is necessary that the width (length in the scanning direction) of the manifold flow passage should be widened to some extent. When the width of the manifold flow passage is widened, the size of the ink-jet head is consequently increased in the scanning direction.

An object of the present teaching is to provide a liquid discharge apparatus and a liquid discharge apparatus unit which make it possible to widen the width of a manifold flow passage which is common to a plurality of nozzles, while suppressing the increase in size of the apparatus.

According to an aspect of the present teaching, there is provided a liquid discharge apparatus including: an individual flow passage member; and a common flow passage member which is joined to the individual flow passage member in a first direction, wherein the individual flow passage member has nozzle groups formed on a surface on a side opposite to the common flow passage member in the first direction and connecting hole groups formed on another surface on a side of the common flow passage member in the first direction, the common flow passage member has manifold flow passages formed corresponding to the connecting hole groups respectively, each of the nozzle groups includes nozzles aligned in a second direction orthogonal to the first direction, each of the connecting hole groups includes connecting holes aligned in the second direction and connected to the nozzles respectively, each of the manifold flow passages extends in the second direction and is connected to the nozzles via the connecting holes, the nozzle groups are arranged in a third direction orthogonal to both of the first direction and the second direction, the connecting hole groups are arranged in the third direction, the manifold flow passages are arranged in the third direction, and at least one spacing between the manifold flow passages is larger than a spacing between the connecting hole groups in the third direction.

DESCRIPTION OF THE EMBODIMENTS

First Embodiment

A first embodiment of the present teaching will be explained below.

<Overall Structure of Printer>

Figure 1:
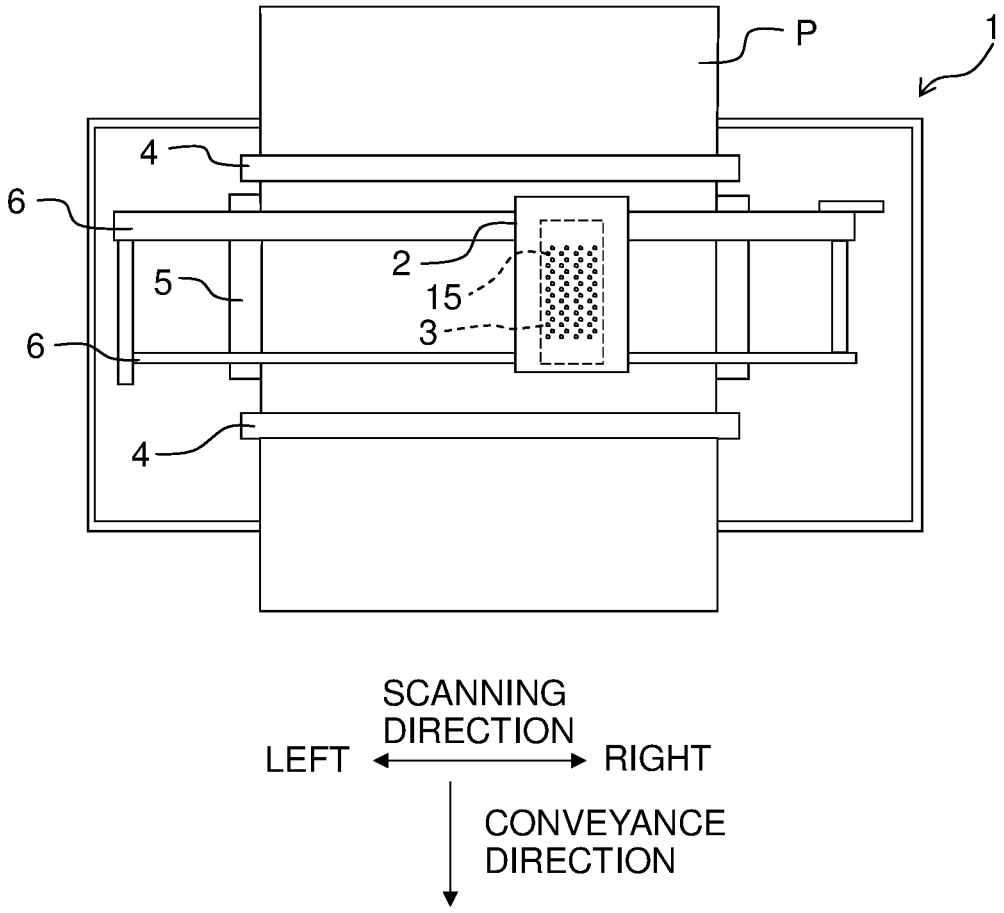
FIG. 1 depicts a schematic arrangement of a printer according to a first embodiment.

As depicted in FIG. 1, a printer 1 according to a first embodiment comprises, for example, a carriage 2, an ink-jet head 3, two recording paper transport rollers 4, and a platen 5. The carriage 2 is supported by two guide rails 6 extending in the scanning direction, and the carriage 2 is movable in the scanning direction along with the guide rails 6. Note that the following explanation will be made while defining the right side and the left side in the scanning direction as depicted in FIG. 1.

The ink-jet head 3 is carried on the carriage 2, and the ink-jet head 3 discharges inks from a plurality of nozzles 15 formed on the lower surface thereof. The structure of the ink-jet head 3 will be explained in detail later on. The two recording paper transport rollers 4 are arranged on the both sides of the carriage 2 in the direction orthogonal to the scanning direction, and the two recording paper transport rollers 4 transport the recording paper P in the transport direction. The platen 5 is arranged opposingly to the ink-jet head 3 between the two recording paper transport rollers 4 in the transport direction, and the platen 5 supports, from the lower side, the recording paper P transported by the recording paper transport rollers 4.

Then, the printer 1 performs the printing on the recording paper P by discharging the inks from the ink-jet head 3 which is reciprocatively moved in the scanning direction together with the carriage 2, while transporting the recording paper P by means of the recording paper transport rollers 4.

<Ink-Jet Head>

Figure 2:
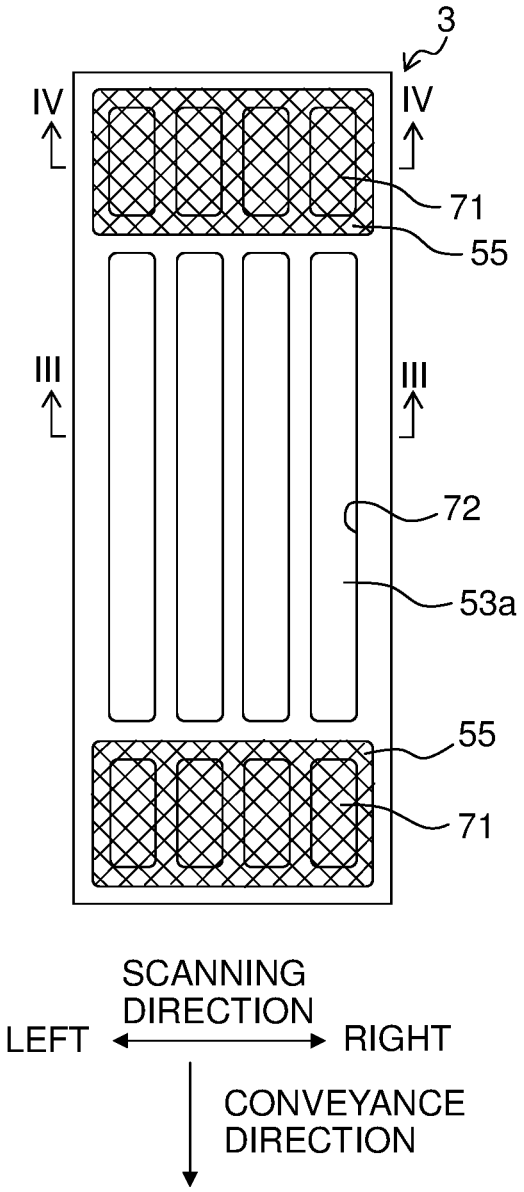
FIG. 2 depicts a plan view illustrating an ink-jet head depicted in FIG. 1.
Figure 3:
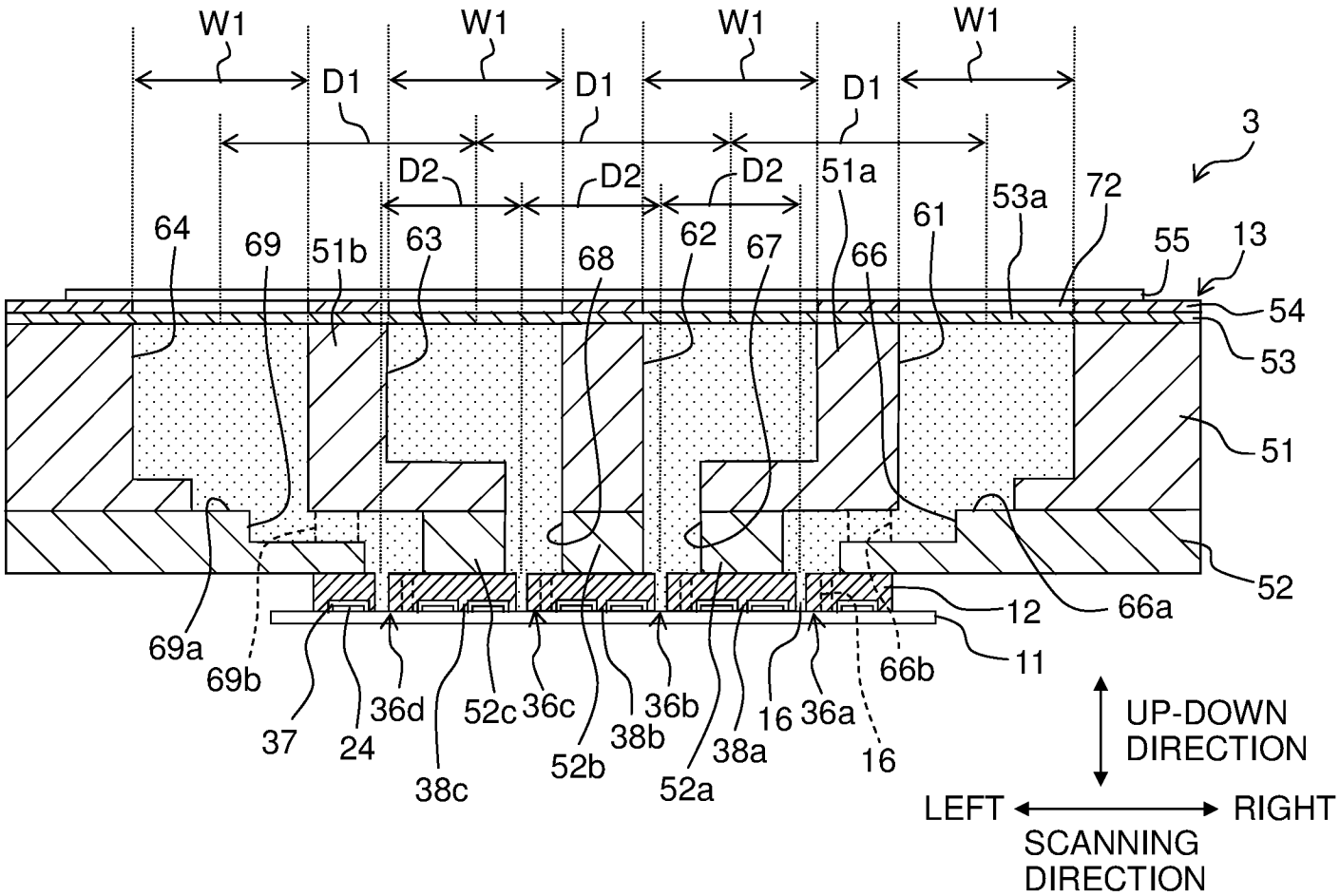
FIG. 3 depicts a sectional view taken along a line III-III in FIG. 2.

Next, the ink-jet head 3 will be explained in detail. As depicted in FIGS. 2 and 3, the ink-jet head 3 is provided with a head chip 11, a support substrate 12, and a manifold unit 13. However, in FIG. 3, for example, the heights of recesses 37 and piezoelectric actuators 24 described later on are depicted to be high in order to show the drawing more comprehensively.

As depicted in FIGS. 5 to 7B, the head chip 11 is provided with a nozzle plate 21, a pressure chamber plate 22, a vibration film 23, and eight piezoelectric actuators 24. However, in FIGS. 5 and 6, the positions of the support substrate 12 and the recess 37 described later on are depicted by alternate long and two short dashes lines.

The nozzle plate 21 is composed of, for example, a synthetic resin material. The nozzle plate 21 is formed with a plurality of nozzles 15. The plurality of nozzles 15 form nozzle arrays 31 by being aligned in the transport direction. Further, the nozzle arrays 31 are aligned in eight arrays in the scanning direction on the nozzle plate 21. Further, the plurality of nozzles 15, which form the odd-numbered nozzle array as counted from the right side in the scanning direction, are deviated to the downstream side in the transport direction by a length which is a half of the spacing (spacing distance or interval) between the nozzles 15 in each of the nozzle arrays 31, with respect to the plurality of nozzles 15 which form the even-numbered nozzle array 31.

Then, the black ink is discharged from the plurality of nozzles 15 which form a nozzle group 32 constructed by the first and second nozzle arrays 31 as counted from the right side in the scanning direction. The yellow ink is discharged from the plurality of nozzles 15 which form a nozzle group 32 constructed by the third and fourth nozzle arrays 31 as counted from the right side. The cyan ink is discharged from the plurality of nozzles 15 which form a nozzle group 32 constructed by the fifth and sixth nozzle arrays 31 as counted from the right side. The magenta ink is discharged from the plurality of nozzles 15 which form a nozzle group 32 constructed by the seventh and eighth nozzle arrays 31 as counted from the right side.

The pressure chamber plate 22 is composed of, for example, silicon (Si), and the pressure chamber plate 22 is arranged on the upper surface of the nozzle plate 21. The pressure chamber plate 22 is formed with a plurality of pressure chambers 10. The plurality of pressure chambers 10 are provided individually with respect to the plurality of nozzles 15. The pressure chamber 10, which corresponds to the nozzle 15 for forming the odd-numbered nozzle array 31 as counted from the right side in the scanning direction, is overlapped with the nozzle 15 at the right end portion. The pressure chamber 10, which corresponds to the nozzle 15 for forming the even-numbered nozzle array 31 as counted from the right side in the scanning direction, is overlapped with the nozzle 15 at the left end portion. Then, the plurality of pressure chambers 10 are arranged as described above, and thus the plurality of pressure chambers 10 form pressure chamber arrays 33 of eight arrays corresponding to the eight arrays of the nozzle arrays 31.

The vibration film 23 is composed of an insulative material such as silicon dioxide ($SiO_2$) or the like, and the vibration film 23 is arranged on the upper surface of the pressure chamber plate 22. The vibration film 23 extends continuously while ranging over the plurality of pressure chambers 10, and the vibration film 23 covers the plurality of pressure chambers 10.

The eight piezoelectric actuators 24 are provided corresponding to the eight arrays of the pressure chamber arrays 33. Each of the piezoelectric actuators 24 is provided with a piezoelectric layer 41, a common electrode 42, and a plurality of individual electrodes 43. The piezoelectric layer 41 is composed of a piezoelectric material containing a main component of lead titanate zirconate, and the piezoelectric layer 41 extends continuously in the transport direction while ranging over the plurality of pressure chambers 10 for forming the pressure chamber array 33. The common electrode 42 is composed of a conductive material such as a metal or the like, and the common electrode 42 is arranged over the substantially entire region of the lower surface of the piezoelectric layer 41. The common electrode 42 is always retained at the ground electric potential. The plurality of individual electrodes 43 are provided individually with respect to the plurality of pressure chambers 10, and the plurality of individual electrodes 43 are overlapped with the corresponding pressure chambers 10. The plurality of individual electrodes 43 are connected to unillustrated driver IC. Any one of the ground electric potential and a predetermined driving electric potential of about 20 V is selectively applied by the driver IC to the plurality of individual electrodes 43 respectively. Further, corresponding to the arrangement of the common electrode 42 and the plurality of individual electrodes 43, the portions, which are interposed between the common electrode 42 of the piezoelectric layer 41 and the respective individual electrodes 43, are polarized in the thickness direction respectively.

<Method for Driving Piezoelectric Actuator>

An explanation will now be made about a method for driving the piezoelectric actuator 24 to discharge the inks from the nozzles 15. In the ink-jet head 3, all of the individual electrodes 43 are previously retained at the ground electric potential. In order to discharge the ink from the nozzle 15, the electric potential of the corresponding individual electrode 43 is switched from the ground electric potential to the driving electric potential. Accordingly, an electric field, which is parallel to the polarization direction, is generated at the portion of the piezoelectric layer 41 interposed between the electrodes in accordance with the electric potential difference between the individual electrode 43 and the common electrode 42. In accordance with this electric field, the concerning portion of the piezoelectric layer 41 is shrunk in the in-plane direction which is orthogonal to the polarization direction. Accordingly, the piezoelectric layer 41 and the vibration film 23 are deformed as a whole to protrude toward the side of the pressure chamber 10, and the volume of the pressure chamber 10 is decreased. As a result, the pressure of the ink contained in the pressure chamber 10 is raised, and the ink is discharged from the nozzle 15 communicated with the pressure chamber 10.

<Support Substrate>

The support substrate 12 is composed of, for example, silicon (Si), and the support substrate 12 is arranged on the upper surface of the vibration film 23. The length in the scanning direction of the support substrate 12 is shorter than the plates 21, 22. The plates 21, 22 protrude from the support substrate 12 on the both sides in the scanning direction. A plurality of throttle flow passages 16, which extend in the upward-downward direction and which penetrate through the support substrate 12 and the vibration film 23, are formed at portions of the support substrate 12 and the vibration film 23 overlapped with end portions of the plurality of pressure chambers 10 disposed on the side opposite to the nozzles 15 in the scanning direction. Accordingly, the plurality of throttle flow passages 16 form eight arrays of throttle flow passage arrays 35 corresponding to the eight arrays of the nozzle arrays 31. Further, the first and second throttle flow passage arrays 35 as counted from the right side, the third and fourth throttle flow passage arrays 35 as counted from the right side, the fifth and sixth throttle flow passage arrays 35 as counted from the right side, and the seventh and eighth throttle flow passage arrays 35 as counted from the right side are arranged closely to one another in the scanning direction respectively to thereby form throttle flow passage groups 36*a* to 36*d*. Further, recesses 37 are formed at portions of the lower surface of the support substrate 12 overlapped with the respective piezoelectric actuators 24. The piezoelectric actuator 24 is accommodated in the recess 37.

<Common Flow Passage Member>

The manifold unit 13 is joined to the upper surface of the support substrate 12. The manifold unit 13 is provided with a first common flow passage member 51, a second common flow passage member 52, a damper film 53, a plate 54, and filters 55.

Figure 8:
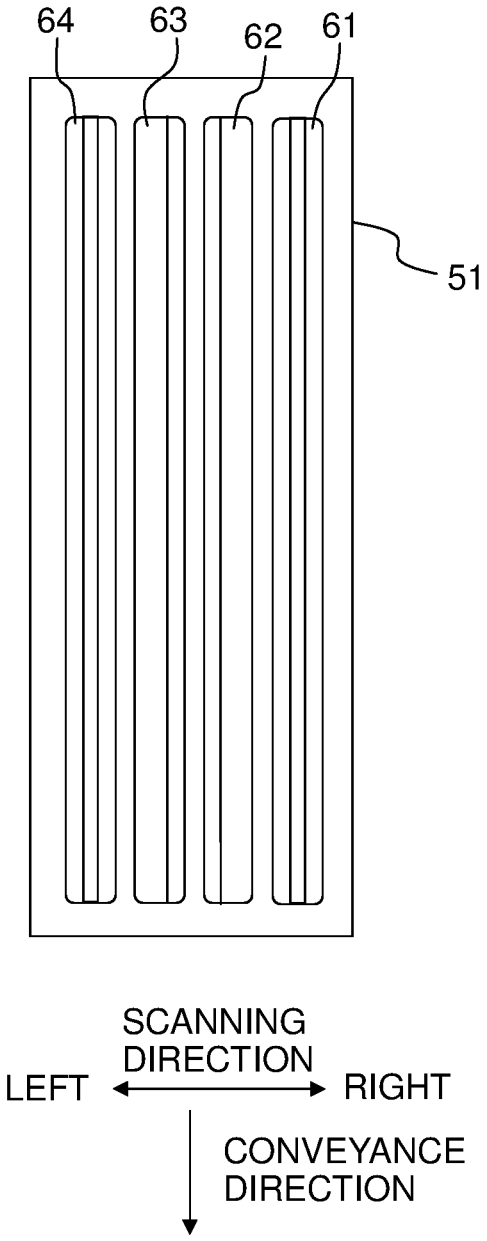
FIG. 8 depicts those in FIG. 2 from which a damper film, a plate, and filters are removed.

The common flow passage members 51, 52 are composed of, for example, ceramic. As depicted in FIGS. 3 and 8, the first common flow passage member 51 and the second common flow passage member 52 are stacked in the upward-downward direction so that the second common flow passage member 52 is disposed on the lower side. The second common flow passage member 52 is joined to the upper surface of the support substrate 12. The lengths in the scanning direction of the common flow passage members 51, 52 are longer than the support substrate 12 and the plates 21, 22. The both ends in the scanning direction protrude from the support substrate 12 and the head chip 11. The common flow passage members 51, 52 are formed with four manifold flow passages 61 to 64 and four connecting flow passages 66 to 69.

The four manifold flow passages 61 to 64 are formed at portions of the first common flow passage member 51 except for the lower end portions. The manifold flow passages 61 to 64 extend in the transport direction respectively, and the manifold flow passages 61 to 64 are aligned in the scanning direction. The manifold flow passage 61, which is arranged on the rightmost side, is positioned on the right side as compared with the throttle flow passage group 36*a*, and the manifold flow passage 61 is not overlapped with the throttle flow passage group 36*a*. The second manifold flow passage 62 as counted from the right side is overlapped with the throttle flow passage group 36*b* at the left end portion. The third manifold flow passage 63 as counted from the right side is overlapped with the throttle flow passage group 36*c* at the right end portion. The manifold flow passage 64, which is arranged on the leftmost side, is positioned on the left side as compared with the throttle flow passage group 36*d*, and the manifold flow passage 64 is not overlapped with the throttle flow passage group 36*d*. Accordingly, the spacing D1 between the manifold flow passages 61 to 64 is larger than the spacing D2 between the throttle flow passage groups 36*a* to 36*d*. Specifically, the spacing D1 is about 1.5 to 2.5 times the spacing D2. For example, the spacing D1 is about 1.5 mm, and the spacing D2 is about 1 mm. Further, as for the manifold flow passages 61 to 64, the widths are identical, which are W1. The lengths in the transport direction are identical as well. Accordingly, as for the manifold flow passages 61 to 64, the volumes are identical as well. Further, the width W1 of each of the manifold flow passages is larger than the spacing D2 between the throttle flow passage groups 36*a* to 36*d*.

The spacing between the manifold flow passages 61 to 64, which is referred to herein, is the spacing between the mutually corresponding portions of the manifold flow passages 61 to 64 such as, for example, the spacing between the central positions in the scanning direction of the respective manifold flow passages 61 to 64 depicted in FIG. 3. Further, the spacing D2 between the throttle flow passage groups 36*a* to 36*d* is the spacing between the corresponding portions of the throttle flow passage groups 36*a* to 36*d* such as, for example, the spacing between the throttle flow passage arrays disposed on the left side of the two throttle flow passage arrays 35 for constructing each of the throttle flow passage groups 36*a* to 36*d* depicted in FIG. 3.

The four connecting flow passages 66 to 69 are formed while ranging over the lower end portions of the first common flow passage member 51 and the second common flow passage member 52. The connecting flow passages 66 to 69 extend in the transport direction respectively, and the connecting flow passages 66 to 69 are aligned in the scanning direction. Further, each of the connecting flow passages 66 to 69 has the width in the scanning direction.

Figure 9:
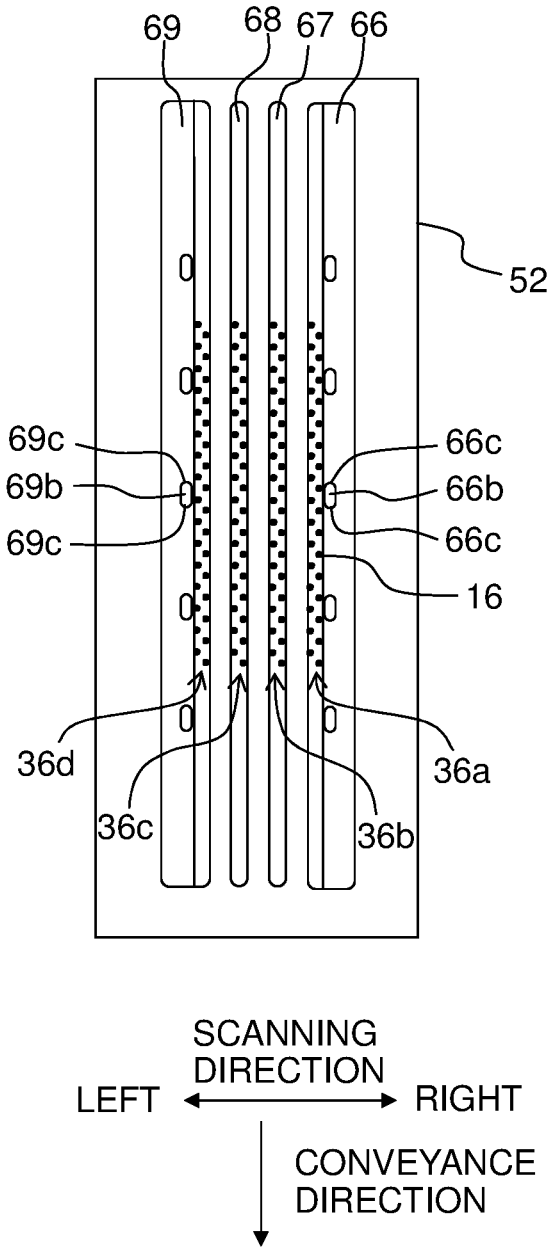
FIG. 9 depicts those in FIG. 8 from which a first common flow passage member is removed.

Further, the connecting flow passage 66, which is disposed on the rightmost side, extends so that the position thereof is lowered toward the left side in the scanning direction. Then, the connecting flow passage 66 is communicated with the left lower end portion of the manifold flow passage 61 at the right upper end portion thereof, and the connecting flow passage 66 is communicated with the plurality of throttle flow passages 16 for forming the throttle flow passage group 36*a* at the left lower end portion thereof. Further, the lower surface 66*a* of the connecting flow passage 66 is formed to have a stepped shape so that the position thereof is lowered toward the left side in the scanning direction, corresponding to the connecting flow passage 66 extending as described above. In other words, the lower surface 66*a* of the connecting flow passage 66 is formed to have the stepped shape directed toward the corresponding throttle flow passage group 36*a*. Further, a plurality of protruding portions 66*b*, which protrude upwardly, are formed on the lower surface 66*a* of the connecting flow passage 66 at portions overlapped with a partition wall 51*a* of the first common flow passage member 51 for partitioning the manifold flow passage 61 and the manifold flow passage 62. The plurality of protruding portions 66*b* are aligned in the transport direction, and upper end portions thereof are joined to the lower surface of the partition wall 51*a* of the first common flow passage member 51. Further, as depicted in FIG. 9, both end surfaces 66*c* of the protruding portion 66*b* in the transport direction have circular arc-shaped curved surfaces as viewed from an upper position.

The second connecting flow passage 67 as counted from the right side extends in the upward-downward direction. The connecting flow passage 67 is communicated with the left lower end portion of the manifold flow passage 62 at the upper end portion thereof. The connecting flow passage 67 is communicated with the plurality of throttle flow passages 16 for forming the throttle flow passage group 36*b* at the lower end portion thereof. The third connecting flow passage 68 as counted from the right side extends in the upward-downward direction. The connecting flow passage 68 is communicated with the right lower end portion of the manifold flow passage 63 at the upper end portion thereof. The connecting flow passage 68 is communicated with the plurality of throttle flow passages 16 for forming the throttle flow passage group 36*c* at the lower end portion thereof.

The connecting flow passage 69, which is disposed on the leftmost side, extends so that the position thereof is lowered toward the right side in the scanning direction. Then, the connecting flow passage 69 is communicated with the right lower end portion of the manifold flow passage 64 at the left upper end portion thereof, and the connecting flow passage 69 is communicated with the plurality of throttle flow passages 16 for forming the throttle flow passage group 36*d* at the right lower end portion thereof. Further, the lower surface 69*a* of the connecting flow passage 69 is formed to have a stepped shape so that the position thereof is lowered toward the right side in the scanning direction, corresponding to the connecting flow passage 69 extending as described above. In other words, the lower surface 69*a* of the connecting flow passage 69 is formed to have the stepped shape directed toward the corresponding throttle flow passage group 36*d*. Further, a plurality of protruding portions 69*b*, which protrude upwardly, are formed on the lower surface 69*a* of the connecting flow passage 69 at portions overlapped with a partition wall 51*b* of the first common flow passage member 51 for partitioning the manifold flow passage 63 and the manifold flow passage 64. The plurality of protruding portions 69*b* are aligned in the transport direction, and upper end portions thereof are joined to the lower surface of the partition wall 51*b* of the first common flow passage member 51. Further, as depicted in FIG. 9, both end surfaces 69*c* of the protruding portion 69*b* in the transport direction have circular arc-shaped curved surfaces as viewed from an upper position.

Further, the partition wall 38*a* of the support substrate 12 described above, which partitions the second and third recesses 37 as counted from the right side, is arranged to be overlapped with the partition wall 52*a* of the second flow passage forming member 52 which mutually partitions the connecting portions of the connecting flow passage 66 and the connecting flow passage 67 with respect to the throttle flow passages 16. Further, the partition wall 38*b* of the support substrate 12, which partitions the fourth and fifth recesses 37 as counted from the right side, is arranged to be overlapped with the partition wall 52*b* of the second flow passage forming member 52 which mutually partitions the connecting portions of the connecting flow passage 67 and the connecting flow passage 68 with respect to the throttle flow passages 16. Further, the partition wall 38*c* of the support substrate 12, which partitions the sixth and seventh recesses 37 as counted from the right side, is arranged to be overlapped with the partition wall 52*c* of the second flow passage forming member 52 which mutually partitions the connecting portions of the connecting flow passage 68 and the connecting flow passage 69 with respect to the throttle flow passages 16.

The damper film 53 is joined to the upper surface of the first common flow passage member 51, and the damper film 53 extends continuously over the four manifold flow passages 61 to 64. Accordingly, the portions of the damper film 53, which are overlapped with the manifold flow passages 61 to 64, serve as damper films 53*a* for forming upper wall surfaces of the manifold flow passages 61 to 64 respectively. The pressure wave is generated in the pressure chamber 10 when the piezoelectric actuator 24 is driven. The pressure wave is transmitted to the manifold flow passage 61 to 64. In this situation, the damper film 53*a* is deformed, and thus the pressure wave can be attenuated.

The plate 54 is joined to the upper surface of the damper film 53. Ink introducing ports 71, which penetrate through the plate 54 and the damper film 53 respectively, are formed at portions of the plate 54 and the damper film 53 overlapped with the both end portions of the manifold flow passages 61 to 64 in the transport direction. The respective ink introducing ports 71 are connected to unillustrated ink cartridges, for example, via unillustrated tubes. The inks are introduced into the manifold flow passages 61 to 64 from the ink introducing ports 71. Further, through-holes 72, which extend in the transport direction, are formed at portions of the plate 54 overlapped with portions except for the both end portions of the manifold flow passages 61 to 64. Accordingly, the deformation of the damper film 53*a* is not inhibited by the plate 54.

The filters 55 are joined to the both end portions in the transport direction of the upper surface of the plate 54, and the filters 55 cover the ink introducing ports 71. Accordingly, when the inks are introduced from the ink introducing ports 71 into the manifold flow passages 61 to 64, any bubble, foreign matter and the like contained in the inks are captured by the filters 55. The bubble and the foreign matter are prevented from flowing into the manifold flow passages 61 to 64.

According to the embodiment explained above, the manifold flow passages 61 to 64 are arranged on the upper side of the head chip 11 and the support substrate 12, and the spacing D1 between the manifold flow passages 61 to 64 is larger than the spacing D2 between the throttle flow passage groups 36*a* to 36*d*. Accordingly, the widths of the manifold flow passages 61 to 64 can be widened (lengths in the scanning direction can be lengthened), and the volumes of the manifold flow passages 61 to 64 can be increased, while suppressing the increase in size of the ink-jet head 3 in the scanning direction, as compared with a case in which manifold flow passages are formed in a head chip and nozzles and the manifold flow passages are arranged while being aligned in the scanning direction. As a result, the pressure wave, which is transmitted to the manifold flow passages 61 to 64, can be efficiently attenuated.

Further, in the first embodiment, the upper wall surfaces of the manifold flow passages 61 to 64 are formed by the damper film 53*a*. Therefore, when the pressure of the ink in the manifold flow passage 61 to 64 is fluctuated, then the damper film 53*a* is deformed, and thus it is possible to attenuate the pressure wave more reliably.

Further, when the spacing D1 between the manifold flow passages 61 to 64 is not less than 1.5 times and not more than 2.5 times the spacing D2 between the throttle flow passage groups 36*a* to 36*d* as in the first embodiment, it is possible to reliably attenuate the pressure wave in the manifold flow passages 61 to 64, while shortening the length in the scanning direction of the ink-jet head 3 (manifold unit 13) as much as possible.

Further, in the first embodiment, the manifold flow passages 61 to 64 have the same volume. Therefore, no dispersion arises among the throttle flow passage arrays 35 in relation to the amount of the ink supplied from the throttle flow passage 16. Accordingly, it is possible to obtain the uniform ink discharge characteristic for the ink discharged from the plurality of nozzles 15 for forming each of the nozzle arrays 31.

Further, in the first embodiment, the ink introducing ports 71 are arranged at the positions overlapped with the both end portions in the transport direction of the manifold flow passages 61 to 64. Therefore, it is possible to suppress the increase in size of the ink-jet head 3 in the scanning direction, for example, as compared with a case in which ink introducing ports are arranged on the outer side in the scanning direction as compared with the manifold flow passages 61 to 64. Further, it is possible to reliably supply the inks to the entire regions of the manifold flow passages 61 to 64 as compared with a case in which the ink introducing ports 71 are arranged at only positions overlapped with the end portions on one side in the transport direction of the manifold flow passages 61 to 64.

Further, in the first embodiment, the filters 55 for covering the ink introducing ports 71 are provided. Therefore, when the inks flow into the manifold flow passages 61 to 64 from the ink introducing ports 71, the bubble and the foreign matter contained in the inks can be captured by the filters 55. It is possible to prevent the bubble and the foreign matter from flowing into the ink-jet head 3.

Further, in the first embodiment, the manifold flow passage 61 is positioned on the right side as compared with the throttle flow passage group 36*a*, and the connecting flow passage 66 extends so that the position thereof is lowered toward the left side in the scanning direction. Accordingly, the ink easily flows from the manifold flow passage 61 into the plurality of throttle flow passages 16 for forming the throttle flow passage group 36*a*. Similarly, in the first embodiment, the manifold flow passage 64 is positioned on the left side as compared with the throttle flow passage group 36*d*, and the connecting flow passage 69 extends so that the position thereof is lowered toward the right side in the scanning direction. Accordingly, the ink easily flows from the manifold flow passage 64 into the plurality of throttle flow passages 16 for forming the throttle flow passage group 36*d*.

Further, in the first embodiment, the portions of the common flow passage members 51, 52, at which the manifold flow passage 61 is formed, protrude from the support substrate 12 to the right side in the scanning direction. Further, the portions of the common flow passage members 51, 52, at which the manifold flow passage 64 is formed, protrude from the support substrate 12 to the left side in the scanning direction. Therefore, if the rigidities of the protruding portions are low, it is feared that the common flow passage members 51, 52 may be deformed when the common flow passage members 51, 52 are joined to the support substrate 12. Further, the portions, which are included in the portions of the common flow passage members 51, 52 protruding from the support substrate 12 and which are separated farther from the support substrate 12, are deformed more easily when the rigidity is low.

In relation thereto, in the first embodiment, the lower surface 66*a* of the connecting flow passage 66 is formed to have the stepped shape so that the position of the lower surface 66*a* of the connecting flow passage 66 is lowered toward the left side in the scanning direction. Accordingly, the portion of the second common flow passage member 52, which protrudes to the right side from the support substrate 12, has the thickness which is more increased at the position farther from the support substrate 12 in the scanning direction. Similarly, the lower surface 69*a* of the connecting flow passage 69 is formed to have the stepped shape so that the position of the lower surface 69*a* of the connecting flow passage 69 is lowered toward the right side in the scanning direction. Accordingly, the portion of the second common flow passage member 52, which protrudes to the left side from the support substrate 12, has the thickness which is more increased at the position farther from the support substrate 12 in the scanning direction. According to the facts as described above, in the first embodiment, it is possible to secure the rigidities of the portions of the common flow passage members 51, 52 protruding from the support substrate 12 in the scanning direction. It is possible to prevent the common flow passage members 51, 52 from being deformed when the common flow passage members 51, 52 are joined to the support substrate 12.

Further, in the first embodiment, the plurality of protruding portions 66*b* are formed at the portions of the lower surface 66*a* of the connecting flow passage 66 overlapped in the upward-downward direction with the partition wall 51*a* of the first common flow passage member 51 for partitioning the manifold flow passage 61 and the manifold flow passage 62. The upper end portions of the protruding portions 66*b* are joined to the lower surface of the partition wall 51*a* of the first common flow passage member 51. Accordingly, it is possible to avoid such a situation that the portion to serve as the partition wall 51*a* of the first common flow passage member 51 is deformed to the lower side when the first common flow passage member 51 and the second common flow passage member 52 are joined to one another.

Similarly, in the first embodiment, the plurality of protruding portions 69*b* are formed at the portions of the lower surface 69*a* of the connecting flow passage 69 overlapped in the upward-downward direction with the partition wall 51*b* of the first common flow passage member 51 for partitioning the manifold flow passage 63 and the manifold flow passage 64. The upper end portions of the protruding portions 69*b* are joined to the lower surface of the partition wall 51*b* of the first common flow passage member 51. Accordingly, it is possible to avoid such a situation that the portion to serve as the partition wall 51*b* of the first common flow passage member 51 is deformed to the lower side when the first common flow passage member 51 and the second common flow passage member 52 are joined to one another.

Further, in the first embodiment, the both end surfaces 66*c*, 69*c* in the transport direction of the protruding portions 66*b*, 69*b* have the circular arc-shaped curved surfaces as viewed from the upper side. Accordingly, it is possible to provide such a structure that the bubbles hardly stay at the end surfaces 66*c*, 69*c*.

Further, in the first embodiment, the partition walls 38*a* to 38*c*, which mutually partition the recesses 37, are arranged at the portions of the support substrate 12 overlapped with the partition walls 52*a* to 52*c* for mutually partitioning the connecting portions of the connecting flow passages 66 to 69 with respect to the throttle flow passages 16. Accordingly, it is possible to avoid such a situation that the support substrate 12 is pushed by the partition walls 52*a* to 52*c* and the recesses 37 are consequently crushed when the common flow passage members 51, 52 are joined to the support substrate 12. As a result, it is possible to avoid any damage of the piezoelectric actuator 24.

Note that in the first embodiment, the pressure chamber plate 22 corresponds to the pressure chamber forming member according to the present teaching, and the support substrate 12 corresponds to the connecting hole forming member according to the present teaching. Then, the combination of the nozzle plate 21, the pressure chamber plate 22, the vibration film 23, and the support substrate 12 corresponds to the individual flow passage member according to the present teaching. Further, the combination of the nozzle 15, the pressure chamber 10, and the throttle flow passage 16 which are communicated with each other corresponds to the individual flow passage according to the present teaching. Further, the throttle flow passage 16 corresponds to the connecting hole according to the present teaching, and the throttle flow passage group 36*a* to 36*d* corresponds to the connecting hole group according to the present teaching. Further, the manifold unit 13 corresponds to the common flow passage member according to the present teaching. Further, the combination of the manifold flow passage 61 to 64 and the connecting flow passage 66 to 69 corresponds to the common flow passage according to the present teaching. Further, the upward-downward direction corresponds to the first direction according to the present teaching, the transport direction corresponds to the second direction according to the present teaching, and the scanning direction corresponds to the third direction according to the present teaching.

Second Embodiment

Figure 10:
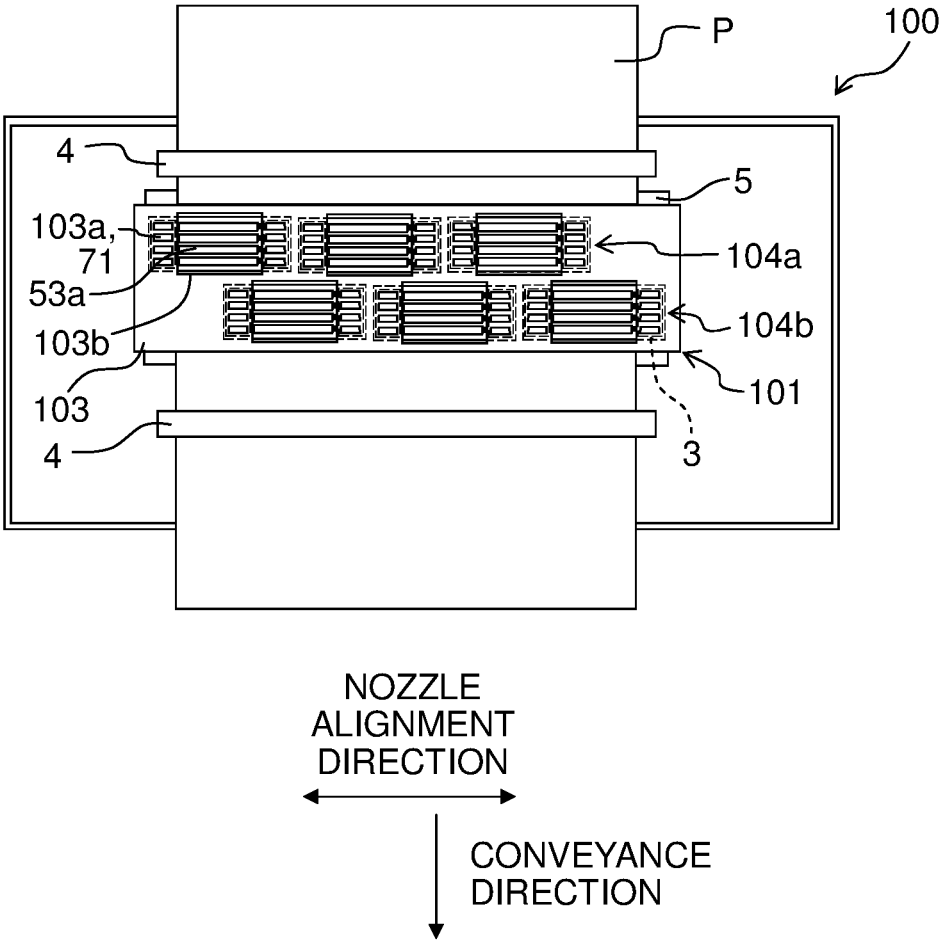
FIG. 10 depicts a drawing of a second embodiment corresponding to FIG. 1.

Next, a preferred second embodiment of the present teaching will be explained. As depicted in FIG. 10, a printer 100 according to the second embodiment comprises a head unit 101 which is arranged between two recording paper transport rollers 4 in the transport direction.

The head unit 101 has six ink-jet heads 3 and a holding plate 103. The ink-jet heads 3 are arranged in such a direction that the nozzle alignment direction, in which a plurality of nozzles 15 (see FIG. 5) are aligned, is orthogonal to the transport direction. Further, each three of the six ink-jet heads 3 are aligned in the nozzle alignment direction to form two head arrays 104*a*, 104*b* thereby. The head array 104*a* and the head array 104*b* are aligned in the transport direction. Further, the ink-jet heads 3 for forming the head array 104*a* are deviated from the ink-jet heads 3 for forming the head array 104*b* in the nozzle alignment direction by a length which is a half of the spacing between the ink-jet heads 3 included in each of the head arrays 104*a*, 104*b*.

The holding plate 103 is a plate-shaped member which is lengthy in the nozzle alignment direction and which extends over the entire length of the recording paper P in the nozzle alignment direction. The six ink-jet heads 3 are joined to the lower surface of the holding plate 103 so that the positional relationship as described above is provided. Thus, the six ink-jet heads 3 are held or retained by the holding plate 103.

Further, the holding plate 103 has through-holes 103*a* which are formed at portions overlapped with ink introducing ports 71 of the respective ink-jet heads 3 respectively. Accordingly, the inks can be introduced via the through-holes 103*a* from the ink introducing ports 71 into the manifold flow passages 61 to 64 (see FIG. 3). Further, the holding plate 103 has through-holes 103*b* which are formed at portions overlapped with portions of the respective ink-jet heads 3 except for the both end portions in the nozzle alignment direction. The through-holes 103*b* are formed in order that the deformation of the damper film 53*a* is not inhibited by the holding plate 103.

Then, in the printer 100, the printing is performed on the recording paper P by discharging the inks from the plurality of nozzles 15 of the six ink-jet heads 3 for forming the head unit 101, while transporting the recording paper P in the transport direction by means of the recording paper transport rollers 4.

In the second embodiment, the ink introducing ports 71 are arranged at the both end portions in the longitudinal direction (nozzle alignment direction) of the manifold flow passages 61 to 64 (see FIG. 8). Therefore, it is possible to suppress the increase in size of the ink-jet head 3 in the transport direction. Accordingly, it is possible to suppress the increase in size of the head unit 101 in the transport direction, the head unit 101 having the two head arrays 104*a*, 104*b* which are aligned in the transport direction.

In this context, in the second embodiment, as depicted in FIG. 10, the ink introducing ports 71 of the two adjoining ink-jet heads 3 of the head array 104*b* are arranged within a range in which the ink-jet head 3 for forming the head array 104*a* is arranged in the nozzle alignment direction. Further, the ink introducing ports 71 of the two adjoining ink-jet heads 3 of the head array 104*a* are arranged within a range in which the ink-jet head 3 for forming the head array 104*b* is arranged in the nozzle alignment direction. Therefore, even when the size of the ink-jet head 3 is increased in the nozzle alignment direction on account of the provision of the ink introducing ports 71, the increase in size of the head unit 101 in the nozzle alignment direction is not so serious.

Note that in the second embodiment, the head unit 101 corresponds to the liquid discharge apparatus unit according to the present teaching. Further, the ink-jet head 3 corresponds to the liquid discharge apparatus according to the present teaching. Further, the up-down direction (direction orthogonal to the paper surface of FIG. 10) corresponds to the first direction according to the present teaching, the nozzle alignment direction corresponds to the second direction according to the present teaching, and the transport direction corresponds to the third direction according to the present teaching.

Next, modified embodiments, in which various changes are made in the first and second embodiments, will be explained.

Figure 11:
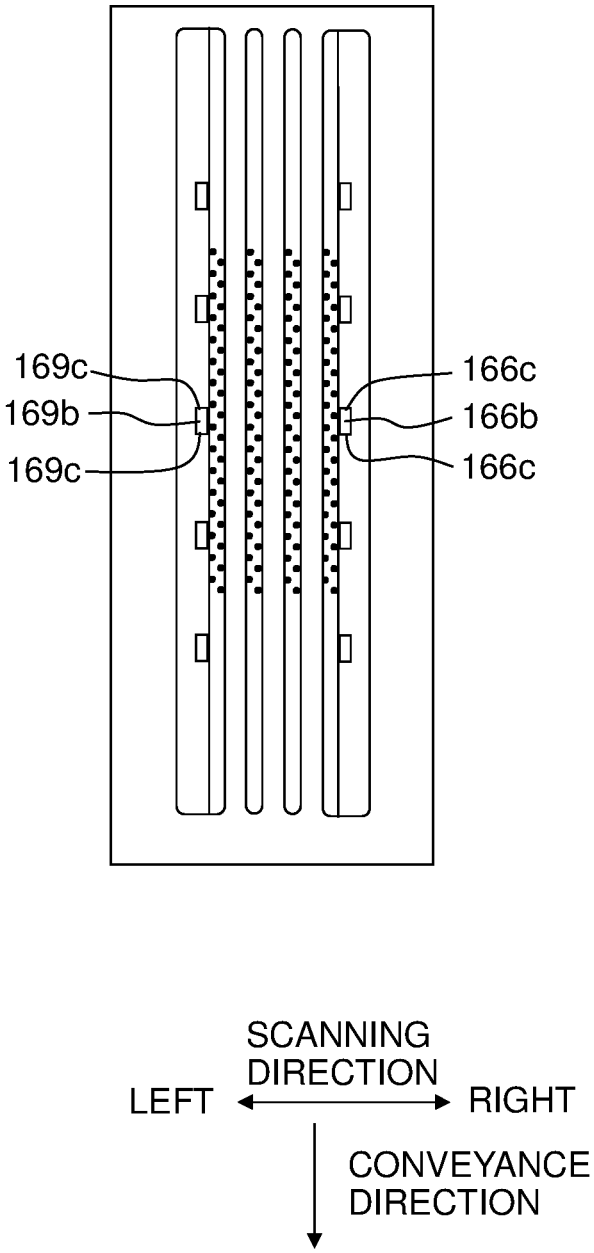
FIG. 11 depicts a plan view illustrating an ink-jet head according to a first modified embodiment, from which a damper film, a plate, and filters are removed.

In the first and second embodiments, the both end surfaces 66*c*, 69*c* in the transport direction of the protruding portions 66*b*, 69*b* are the curved surfaces. However, there is no limitation thereto. In a first modified embodiment, as depicted in FIG. 11, both end surfaces 166*c*, 169*c* of protruding portions 166*b*, 169*b* are flat surfaces which are parallel to the scanning direction.

Figure 12:
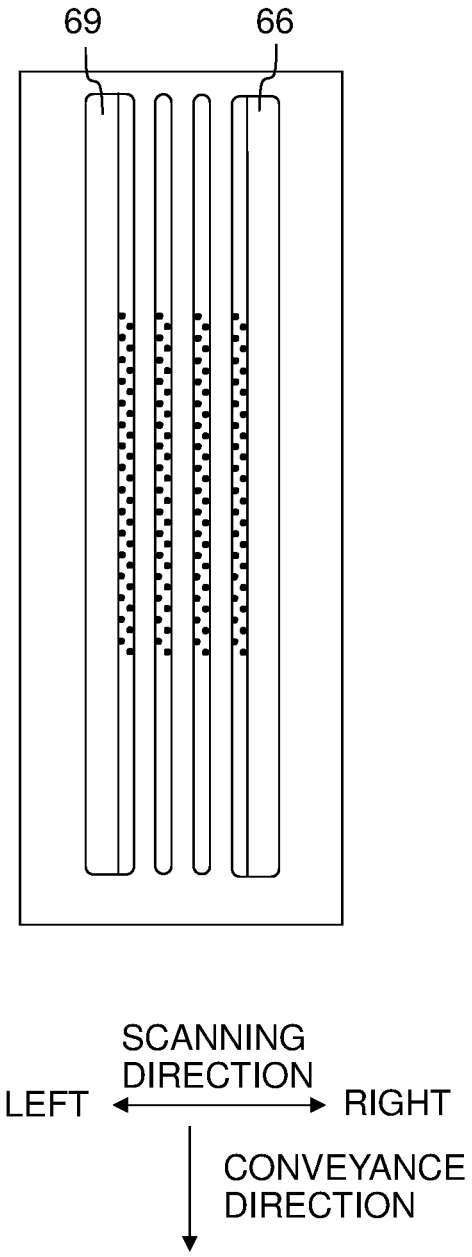
FIG. 12 depicts a plan view illustrating an ink-jet head according to a second modified embodiment, from which a damper film, a plate, and filters are removed.

Further, in the first and second embodiments, the protruding portions 66*b*, 69*b*, which are joined to the lower surface of the first common flow passage member 51, are formed on the lower surfaces 66*a*, 69*a* of the connecting flow passages 66, 69. However, there is no limitation thereto. In a second modified embodiment, as depicted in FIG. 12, the protruding portions 66*b*, 69*b* (see FIG. 9) are not formed on the lower surfaces 66*a*, 69*a* of the connecting flow passages 66, 69.

Figure 13:
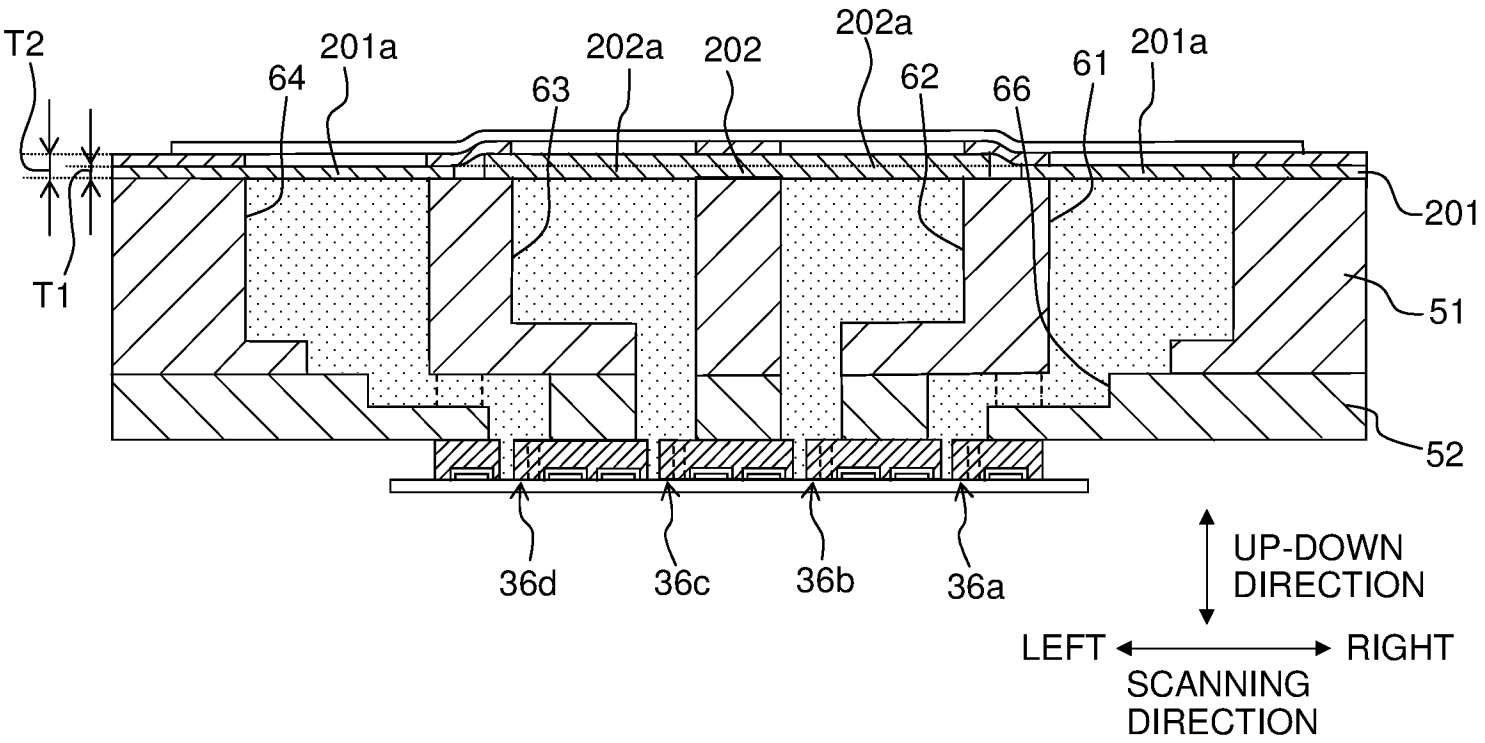
FIG. 13 depicts a sectional view illustrating an ink-jet head according to a third modified embodiment.

Further, in the first and second embodiments, the damper film 53*a*, which forms the upper wall surfaces of the respective manifold flow passages 61 to 64, has the same thickness and the same areal size. However, there is no limitation thereto. In a third modified embodiment, as depicted in FIG. 13, damper films 201 for covering the manifold flow passages 61, 64 and a damper film 202 for covering the manifold flow passages 62, 63 are joined to the upper surface of the first common flow passage member 51 in place of the damper film 53 (see FIG. 3). Further, the thickness T1 of the damper film 201 is thinner than the thickness T2 of the damper film 202.

The manifold flow passages 61, 64 are not overlapped with the throttle flow passage groups 36*a*, 36*d*, while the manifold flow passages 62, 63 are overlapped with the throttle flow passage groups 36*b*, 36*c*. Therefore, it is difficult to transmit the pressure wave to the manifold flow passages 61, 64 as compared with the manifold flow passages 62, 63. Therefore, it is difficult to attenuate the pressure wave which is generated in the pressure chamber 10 (see FIG. 5) corresponding to the throttle flow passage group 36*a*, 36*d*, as compared with the pressure wave which is generated in the pressure chamber 10 (see FIG. 5) corresponding to the throttle flow passage group 36*b*, 36*c*. In the third modified embodiment, as described above, the thickness T1 of the damper film 201 is thinned as compared with the thickness T2 of the damper film 202. Accordingly, the thickness T1 of the damper film 201*a* for forming the upper wall surface of the manifold flow passage 61, 64 is thinner than the thickness T2 of the damper film 202*a* for forming the upper wall surface of the manifold flow passage 62, 63. Accordingly, the damper film 201*a* is easily deformed as compared with the damper film 202*a*. The pressure wave can be efficiently attenuated in the manifold flow passages 61, 64 in which it is difficult to transmit the pressure wave.

Note that in the third modified embodiment, the manifold flow passages 62, 63 correspond to the first manifold flow passage according to the present teaching, and the manifold flow passages 61, 64 correspond to the second manifold flow passage according to the present teaching.

Figure 14:
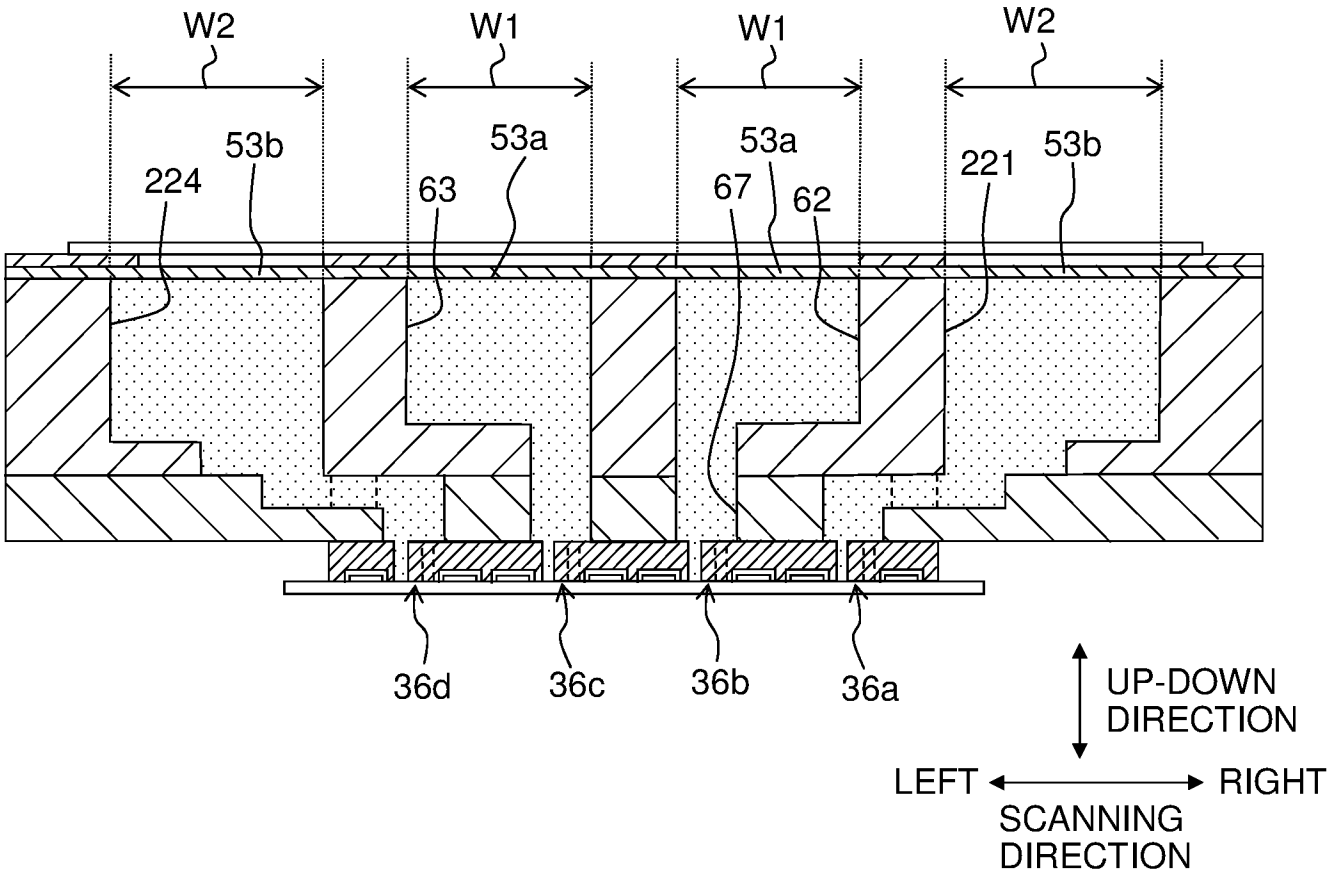
FIG. 14 depicts a sectional view illustrating an ink-jet head according to a fourth modified embodiment.

In a fourth modified embodiment, as depicted in FIG. 14, the width W2 of manifold flow passages 221, 224 overlapped with the throttle flow passage groups 36*a*, 36*d* is wider than the width W1 of manifold flow passages 62, 63 not overlapped with the throttle flow passage groups 36*b*, 36*c*.

In the same manner as the third modified embodiment, it is difficult to transmit the pressure wave to the manifold flow passages 221, 224 as compared with the manifold flow passages 62, 63. In the fourth modified embodiment, as described above, the width W2 of the manifold flow passages 221, 224 is larger than the width W1 of the manifold flow passages 62, 63. Accordingly, the areal size of the damper film 53*b* for forming the upper wall surface of the manifold flow passage 221, 224 is larger than the areal size of the damper film 53*a* for forming the upper wall surface of the manifold flow passage 62, 63. Therefore, the damper film 53*b* is easily deformed as compared with the damper film 53*a*. The pressure wave can be efficiently attenuated in the manifold flow passages 221, 224 in which it is difficult to transmit the pressure wave.

Note that in the fourth modified embodiment, the manifold flow passages 62, 63 correspond to the first manifold flow passage according to the present teaching, and the manifold flow passages 221, 224 correspond to the second manifold flow passages according to the present teaching.

Figure 15A:
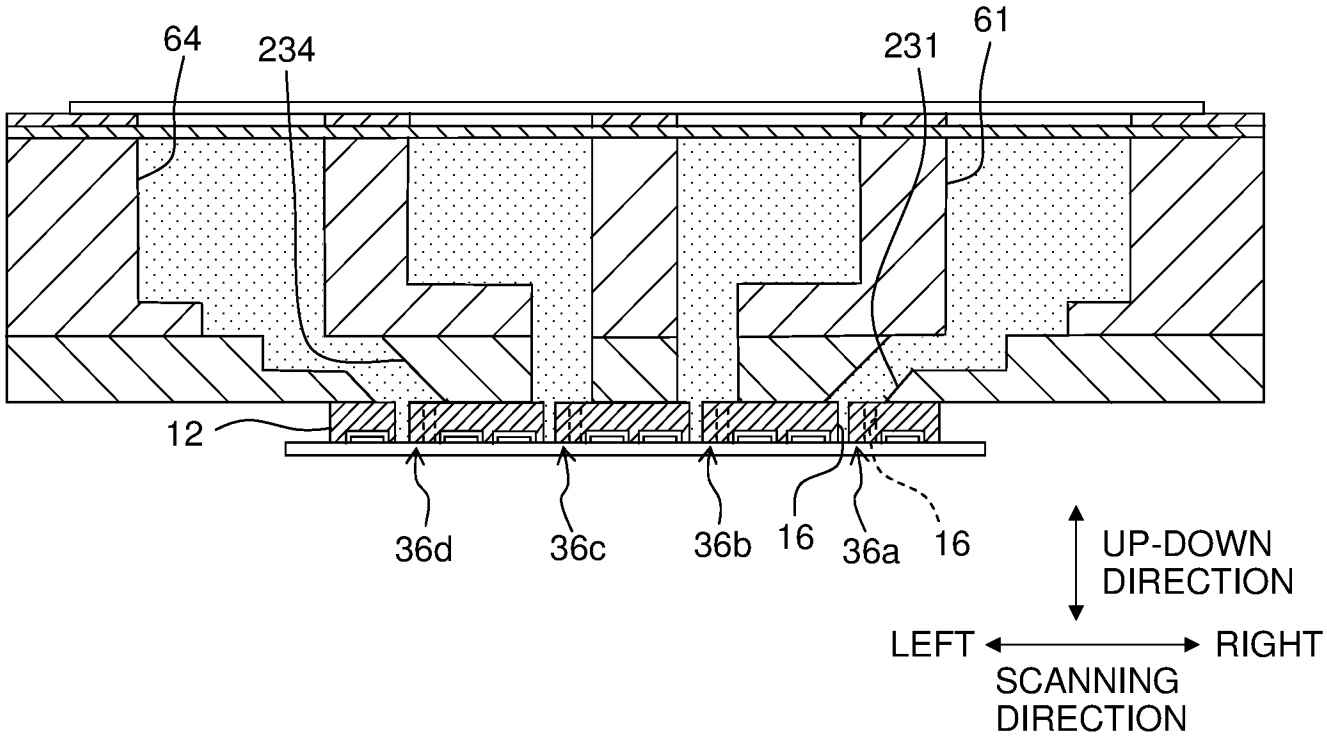
FIGS. 15A and 15B depict sectional views illustrating an ink-jet head according to modified embodiments 5A and 5B, respectively.
Figure 15B:
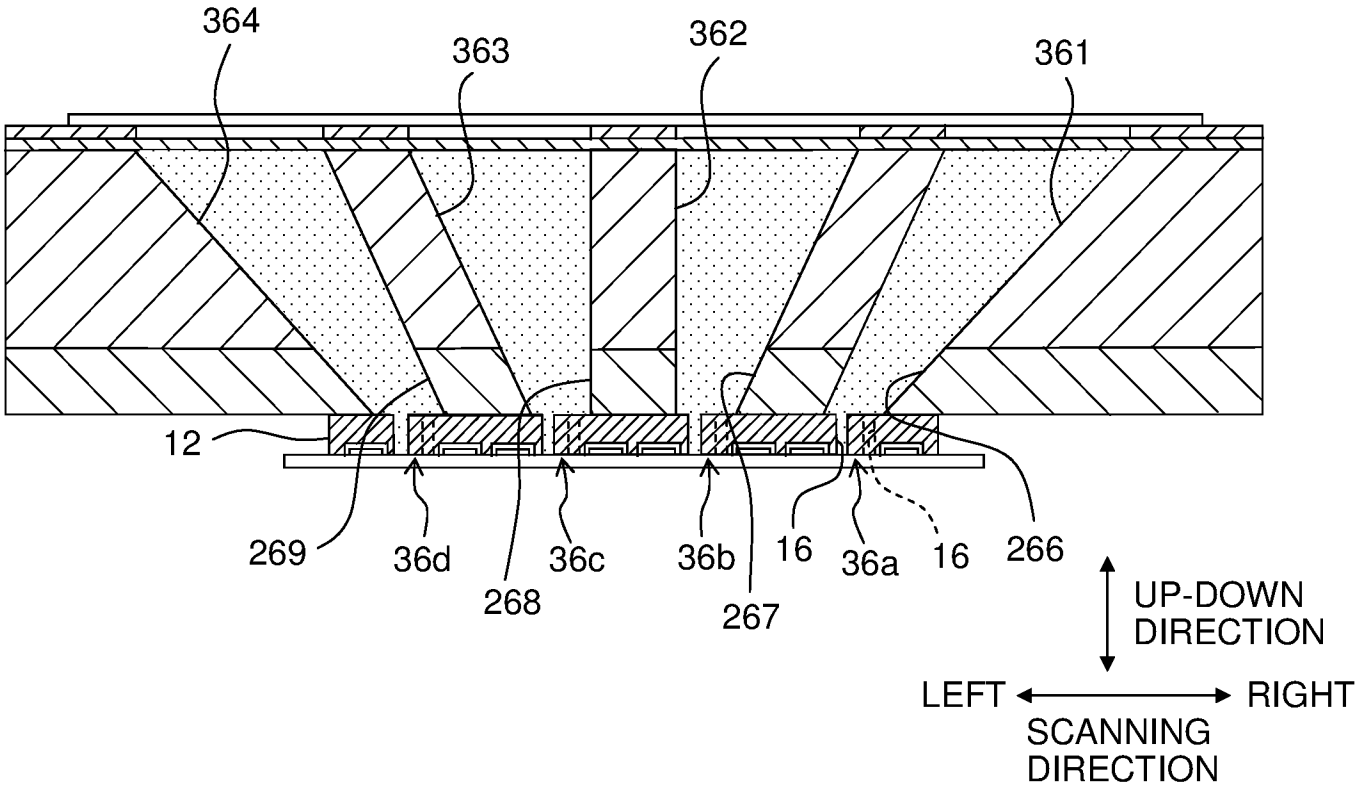

Further, in the embodiment described above, all of the connecting portions of the connecting flow passages 66 to 69 with respect to the plurality of throttle flow passages 16 extend in parallel to the upward-downward direction. However, there is no limitation thereto. In a fifth modified embodiment A, as depicted in FIG. 15A, a connecting flow passage 231 for connecting the manifold flow passage 61 and the throttle flow passage group 36*a* has a connecting portion with respect to the plurality of throttle flow passages 16, the connecting portion being inclined with respect to the upward-downward direction so that the position thereof is lowered toward the left side in the scanning direction, in other words, the connecting portion approaches the support substrate 12 at positions nearer to the throttle flow passage group 36*a*. Further, a connecting flow passage 234 for connecting the manifold flow passage 64 and the throttle flow passage group 36*d* has a connecting portion with respect to the plurality of throttle flow passages 16, the connecting portion being inclined with respect to the upward-downward direction so that the position thereof is lowered toward the right side in the scanning direction, in other words, the connecting portion approaches the support substrate 12 at positions nearer to the throttle flow passage group 36*d*. In this case, the inks contained in the connecting flow passages 231, 234 more easily flow into the plurality of throttle flow passages 16. Further, as in a fifth modified embodiment B depicted in FIG. 15B, each of manifold flow passages 361 to 364 may be formed so that the width in the scanning direction is continuously reduced toward the lower side. Each of the connecting flow passages 266 to 269 may be also formed so that the width in the scanning direction is continuously reduced toward the lower side. Each of the lower ends of the manifold flow passages 361 to 364 may be connected to each of upper ends of the connecting flow passages 266 to 269. Also in the case of this structure, the inks contained in the manifold flow passages 361 to 364 and the connecting flow passages 266 to 269 more easily flow into the throttle flow passage groups 36*a* to 36*d* respectively. Further, in the same manner as the first embodiment, the pressure wave, which is transmitted to the manifold flow passages 361 to 364, can be efficiently attenuated, while suppressing the increase in size of the ink-jet head in the scanning direction.

Figure 16:
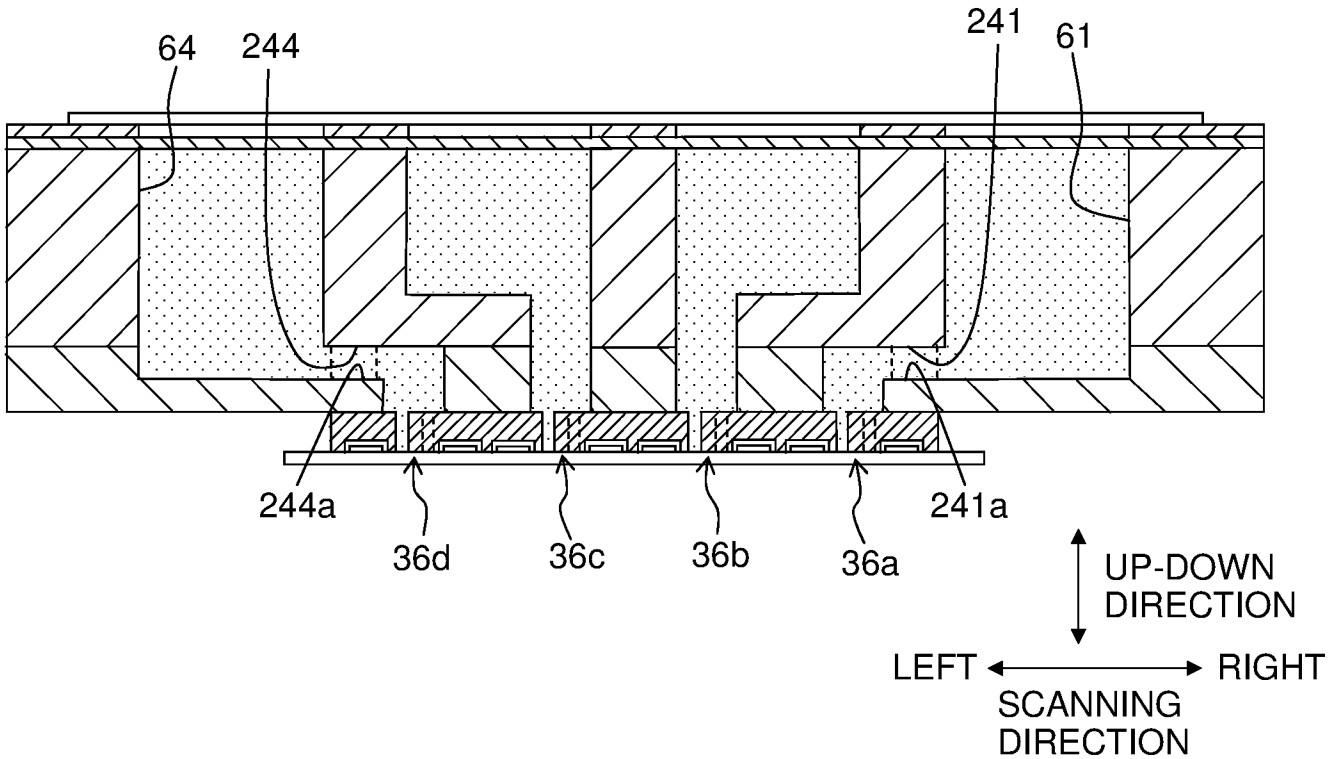
FIG. 16 depicts a sectional view illustrating an ink-jet head according to a sixth modified embodiment.

Further, in the first and second embodiments, the lower surfaces 66*a*, 69*a* of the connecting flow passages 66, 69 are formed to have the stepped shapes. However, there is no limitation thereto. In a sixth modified embodiment, as depicted in FIG. 16, a lower surface 241*a* of a connecting flow passage 241 for connecting the manifold flow passage 61 and the plurality of throttle flow passages 16 for forming the throttle flow passage group 36*a* and a lower surface 244*a* of a connecting flow passage 244 for connecting the manifold flow passage 64 and the plurality of throttle flow passages 16 for forming the throttle flow passage group 36*d* are flat surfaces which are parallel to the scanning direction and the transport direction.

Figure 17:
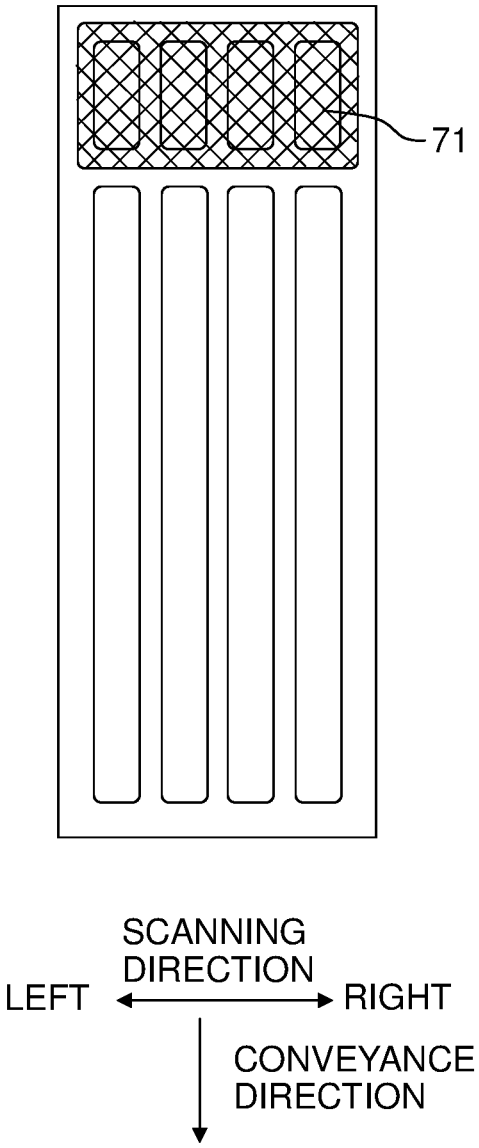
FIG. 17 depicts a plan view illustrating an ink-jet head according to a seventh modified embodiment.

Further, in the first and second embodiments, the ink introducing ports 71 are arranged at the positions overlapped with the both end portions in the transport direction of the manifold flow passages 61 to 64. However, there is no limitation thereto. In a seventh modified embodiment, as depicted in FIG. 17, the ink introducing ports 71 are arranged only at positions overlapped with the end portions on the upstream side in the transport direction of the manifold flow passages 61 to 64. On the contrary, unlike the seventh modified embodiment, it is also allowable that the ink introducing ports 71 are arranged at only positions overlapped with the end portions on the downstream side in the transport direction of the manifold flow passages 61 to 64.

Further, in the first and second embodiments, it is also allowable that the ink introducing ports 71, which are disposed on one side and which are included in the ink introducing ports 71 arranged at the positions overlapped with the both end portions in the transport direction of the manifold flow passages 61 to 64, are used as ink outflow ports for allowing the inks to flow out from the manifold flow passages 61 to 64 to the ink cartridges, and the inks are circulated between the ink cartridges and the manifold flow passages 61 to 64.

Further, in the first and second embodiments, the filter 55 is arranged to cover the ink introducing ports 71. However, it is also allowable that the filter 55 is absent.

Further, in the first and second embodiments, the spacing D1 between the manifold flow passages 61 to 64 is not less than 1.5 times and not more than 2.5 times the spacing D2 between the throttle flow passage groups 36*a* to 36*d*. However, there is no limitation thereto. The spacing D1 may be less than 1.5 times the spacing D2, or the spacing D1 may be larger than 2.5 times the spacing D2, provided that the spacing D1 between the manifold flow passages 61 to 64 is larger than the spacing D2 between the throttle flow passage groups 36*a* to 36*d*.

Figure 18:
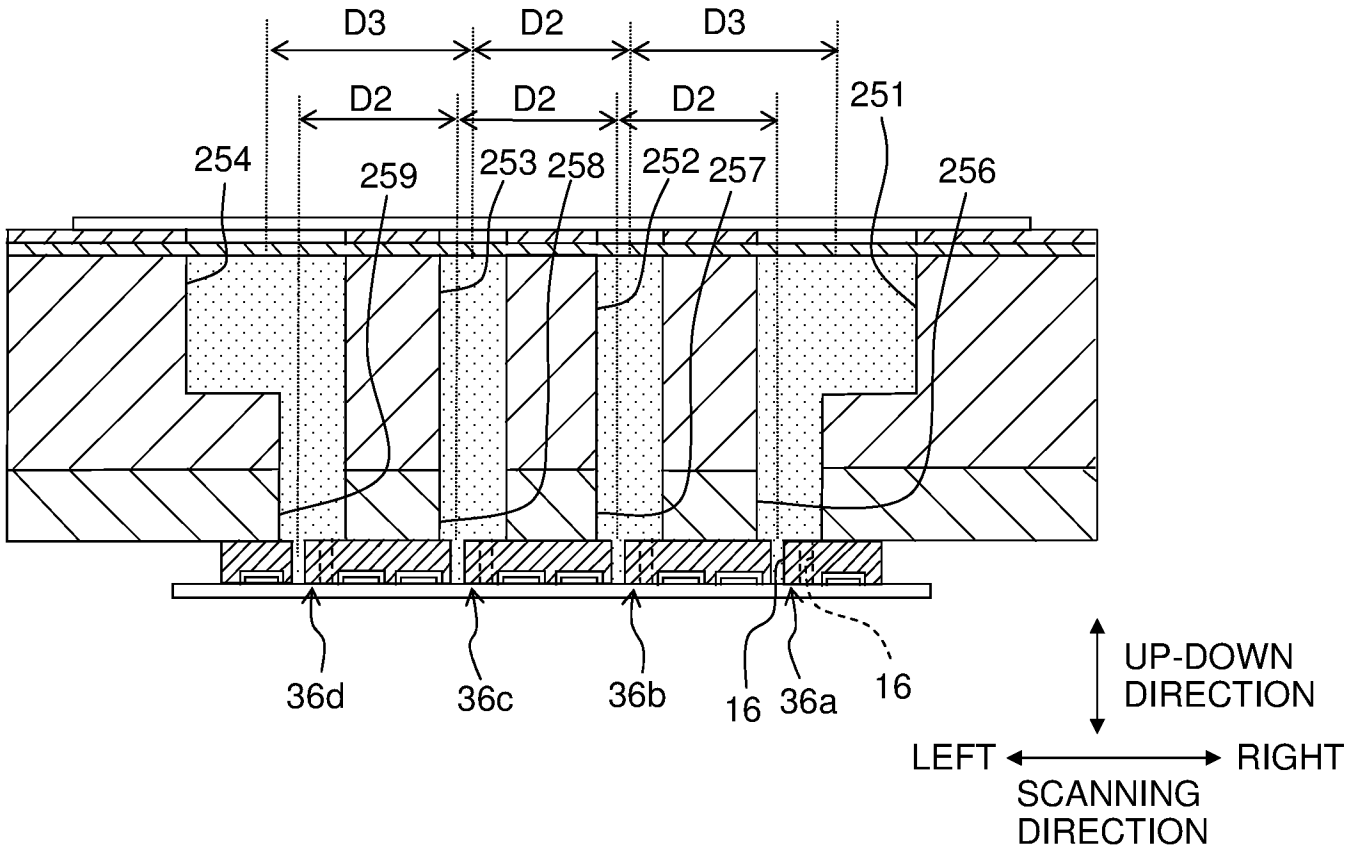
FIG. 18 depicts a sectional view illustrating an ink-jet head according to an eighth modified embodiment.

Further, in the first and second embodiments, all of the spacings D1 between the manifold flow passages 61 to 64 are the same, and the spacings D1 are larger than the spacings D2 between the throttle flow passage groups 36*a* to 36*d*. However, there is no limitation thereto. In an eighth modified embodiment, as depicted in FIG. 18, a manifold flow passage 251, which is communicated with the plurality of throttle flow passages 16 for forming the throttle flow passage group 36*a*, has a width wider than that of a connecting flow passage 256 which connects the manifold flow passage 251 and the plurality of throttle flow passages 16 for forming the throttle flow passage group 36*a*. Similarly, a manifold flow passage 254, which is communicated with the plurality of throttle flow passages 16 for forming the throttle flow passage group 36*d*, has a width wider than that of a connecting flow passage 259 which connects the manifold flow passage 254 and the plurality of throttle flow passages 16 for forming the throttle flow passage group 36*d*.

On the other hand, a manifold flow passage 252, which is communicated with the plurality of throttle flow passages 16 for forming the throttle flow passage group 36*b*, has the same width as that of a connecting flow passage 257 which connects the manifold flow passage 252 and the plurality of throttle flow passages 16 for forming the throttle flow passage group 36*b*. Similarly, a manifold flow passage 253, which is communicated with the plurality of throttle flow passages 16 for forming the throttle flow passage group 36*c*, has the same width as that of a connecting flow passage 258 which connects the manifold flow passage 253 and the plurality of throttle flow passages 16 for forming the throttle flow passage group 36*c*.

Then, the spacing between the manifold flow passage 251 and the manifold flow passage 252 and the spacing between the manifold flow passage 253 and the manifold flow passage 254 are the spacing D3 which is larger than the spacing D2 between the throttle flow passage groups 36*a* to 36*d*. On the other hand, the spacing between the manifold flow passage 252 and the manifold flow passage 253 is the same spacing D2 as the spacing between the throttle flow passage groups 36*a* to 36*d*.

Further, in the first and second embodiments, all of the manifold flow passages 61 to 64 have the same volume. However, it is also allowable to vary the volume between the manifold flow passages. For example, in the fourth modified embodiment described above, the width W2 of the manifold flow passage 221, 224 is wider than the width W1 of the manifold flow passage 62, 63. Therefore, the volume of the manifold flow passage 221, 224 is larger than the volume of the manifold flow passage 62, 63. Further, in the eight modified embodiment described above, the volume of the manifold flow passage 251, 254 is larger than the volume of the manifold flow passage 252, 253.

Figure 19:
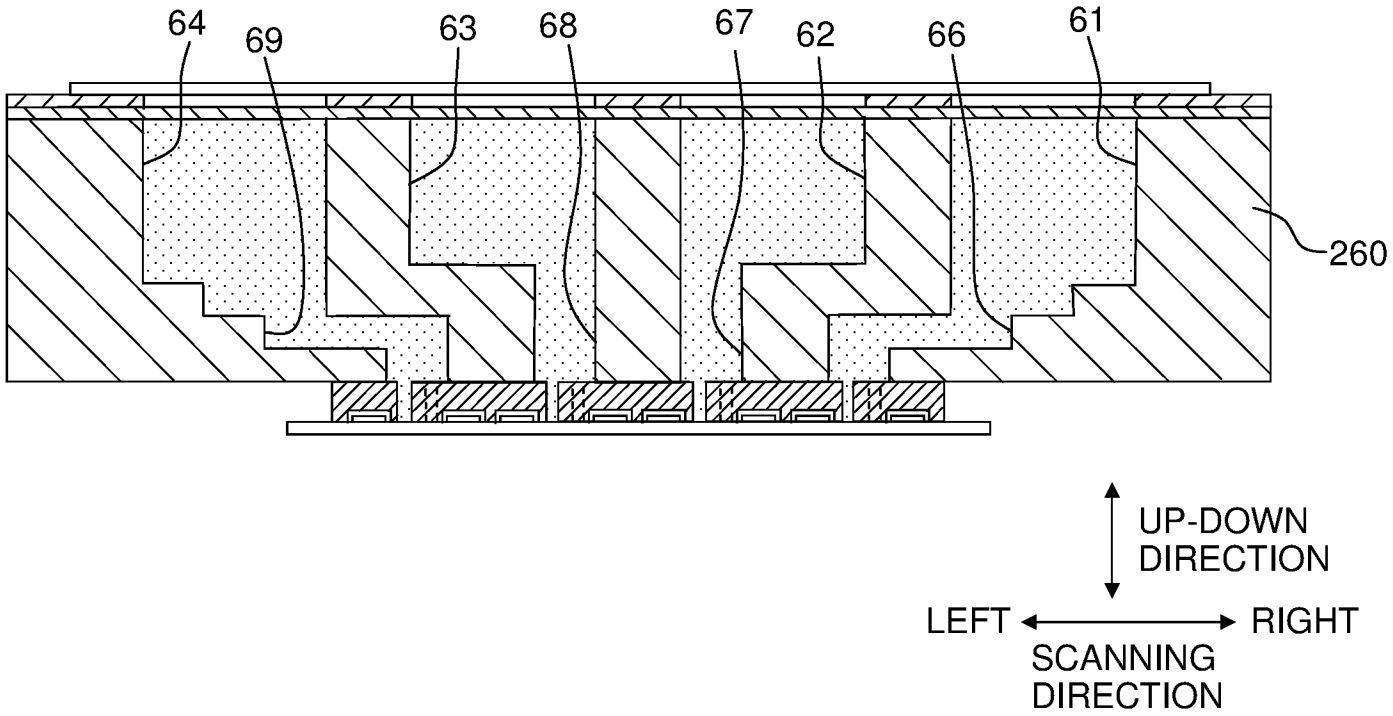
FIG. 19 depicts a sectional view illustrating an ink-jet head according to a ninth modified embodiment.

Further, in the first and second embodiments, the stack of the first common flow passage member 51 and the second common flow passage member 52 is formed with the manifold flow passages 61 to 64 and the connecting flow passages 66 to 69. However, there is no limitation thereto. In a ninth modified embodiment, as depicted in FIG. 19, one flow passage member 260 is formed with manifold flow passages 61 to 64 and connecting flow passages 66 to 69. Note that in this case, for example, the flow passage member 260 is composed of a synthetic resin, and the flow passage member 260 is formed by means of the resin molding.

Figure 20:
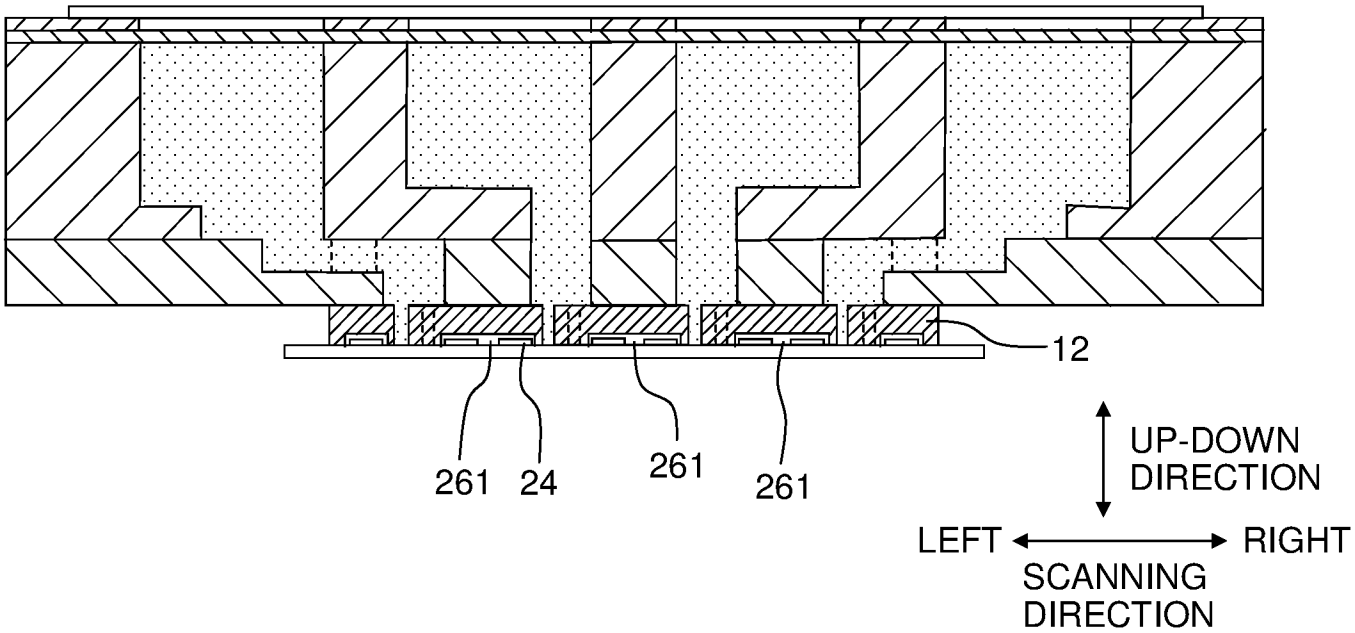
FIG. 20 depicts a sectional view illustrating an ink-jet head according to a tenth modified embodiment.

Further, in the first and second embodiments, the partition walls 38*a* to 38*c*, which mutually partition the recesses 37, are arranged at the positions different from those of the partition walls 52*a* to 52*c*, of the support substrate 12. However, there is no limitation thereto. In a tenth modified embodiment, as depicted in FIG. 20, one recess 261, which is formed on the lower surface of the support substrate 12, accommodates each of the second and third piezoelectric actuators 24 as counted from the right side in the scanning direction, the fourth and fifth piezoelectric actuators 24 as counted from the right side in the scanning direction, and the sixth and seventh piezoelectric actuators 24 as counted from the right side in the scanning direction. That is, in the tenth modified embodiment, the partition walls 38*a* to 38*c* of the first and second embodiments (see FIG. 3) are absent.

Figure 4:
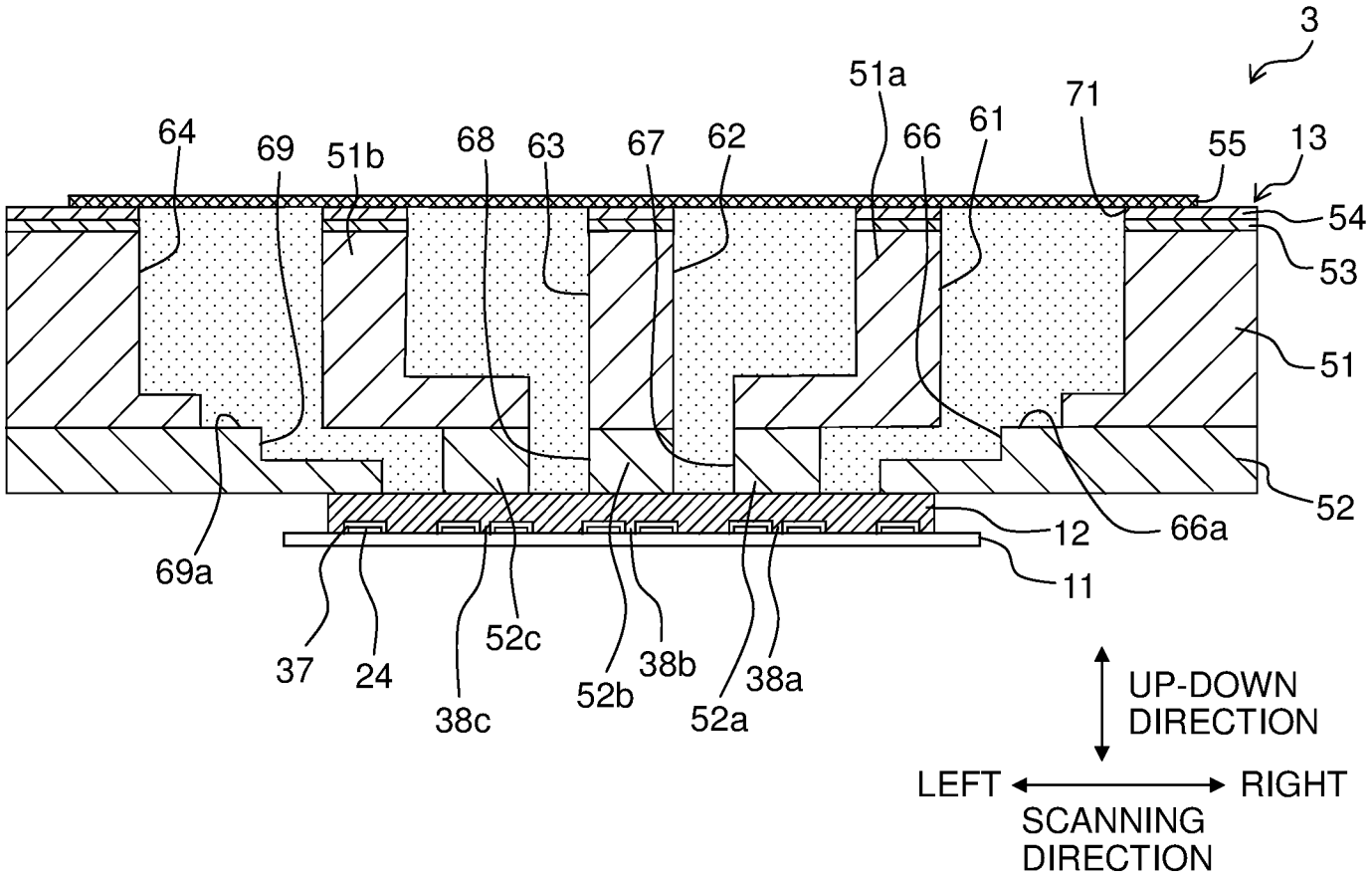
FIG. 4 depicts a sectional view taken along a line IV-IV in FIG. 2.
Figure 5:
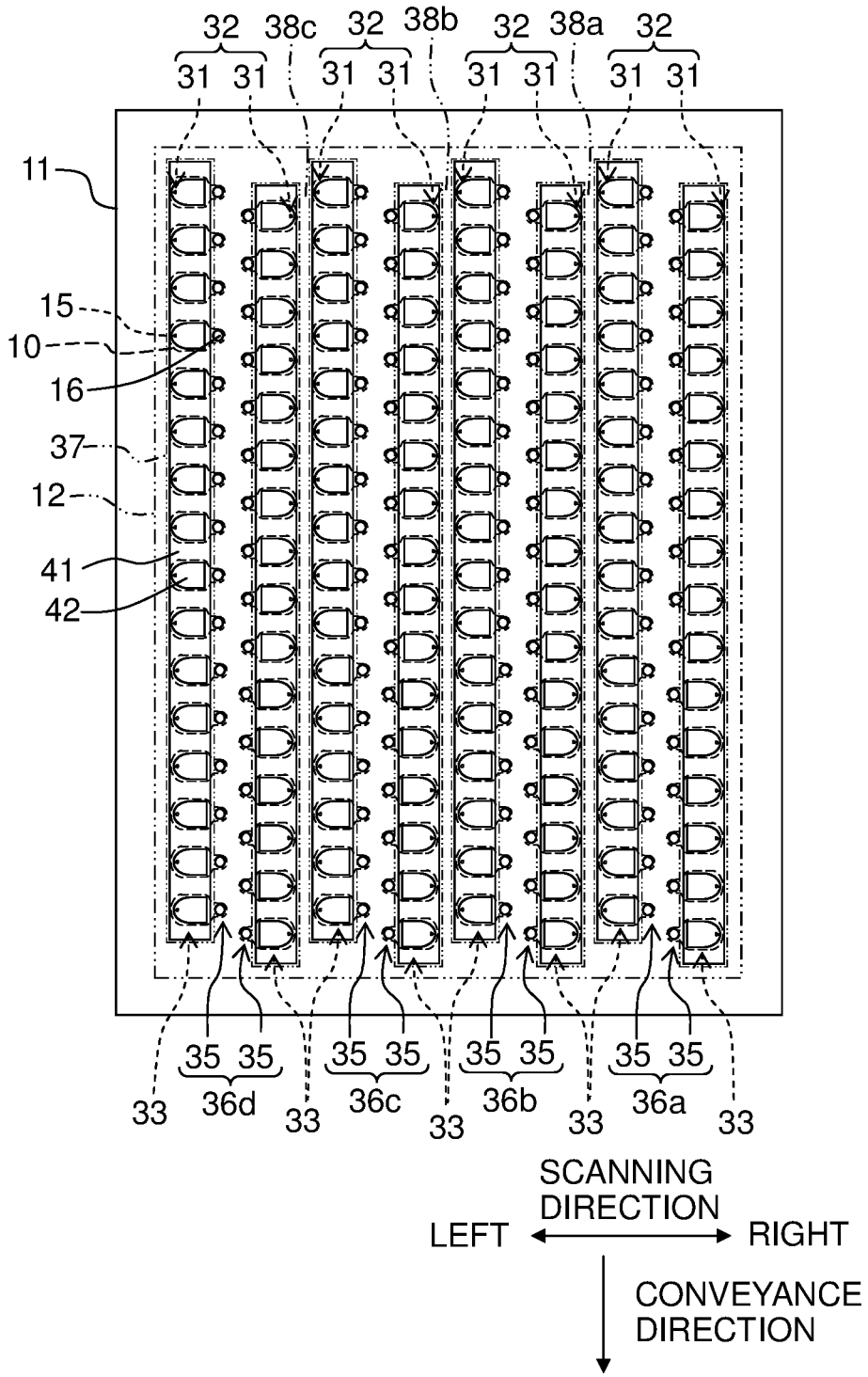
FIG. 5 depicts a plan view illustrating a head chip.
Figure 6:
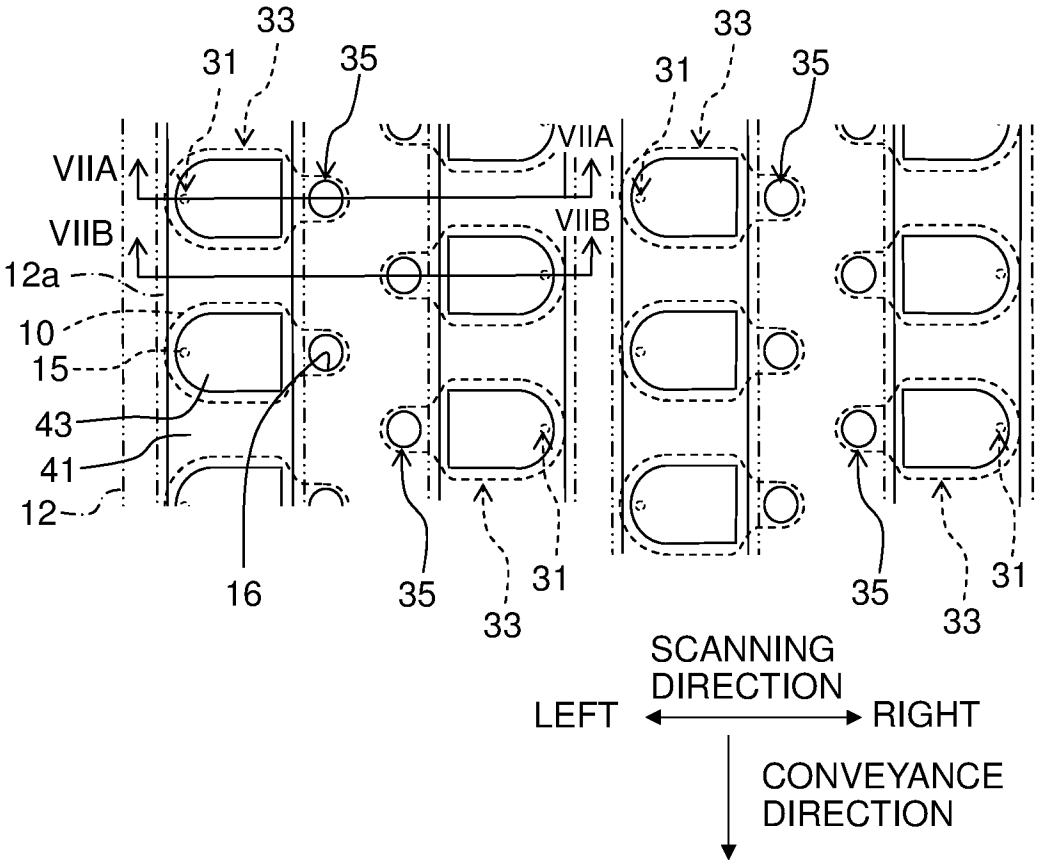
FIG. 6 depicts an enlarged view illustrating a part of FIG. 5.
Figure 7A:
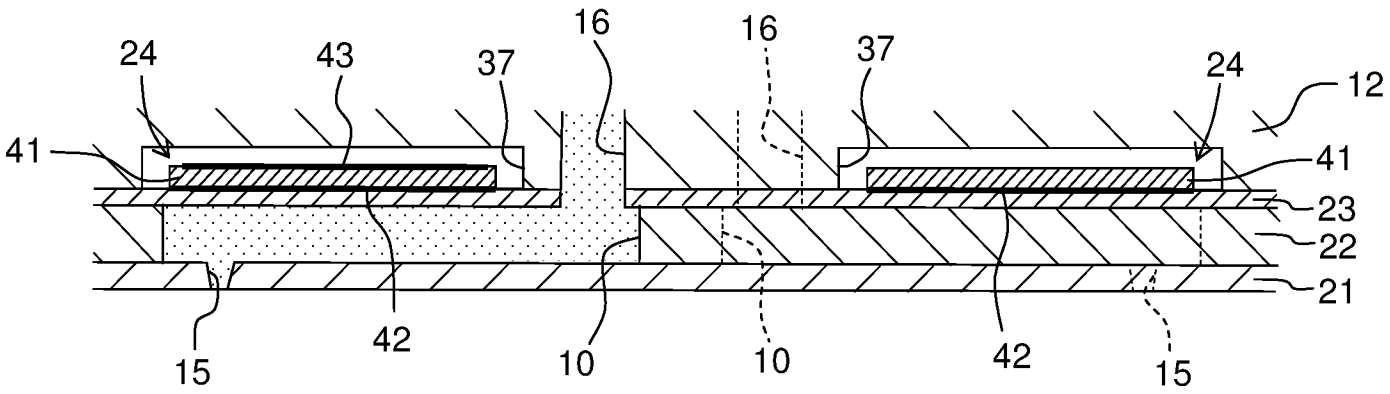
FIG. 7A depicts a sectional view taken along a line VIIA-VIIA in FIG. 6.
Figure 7B:
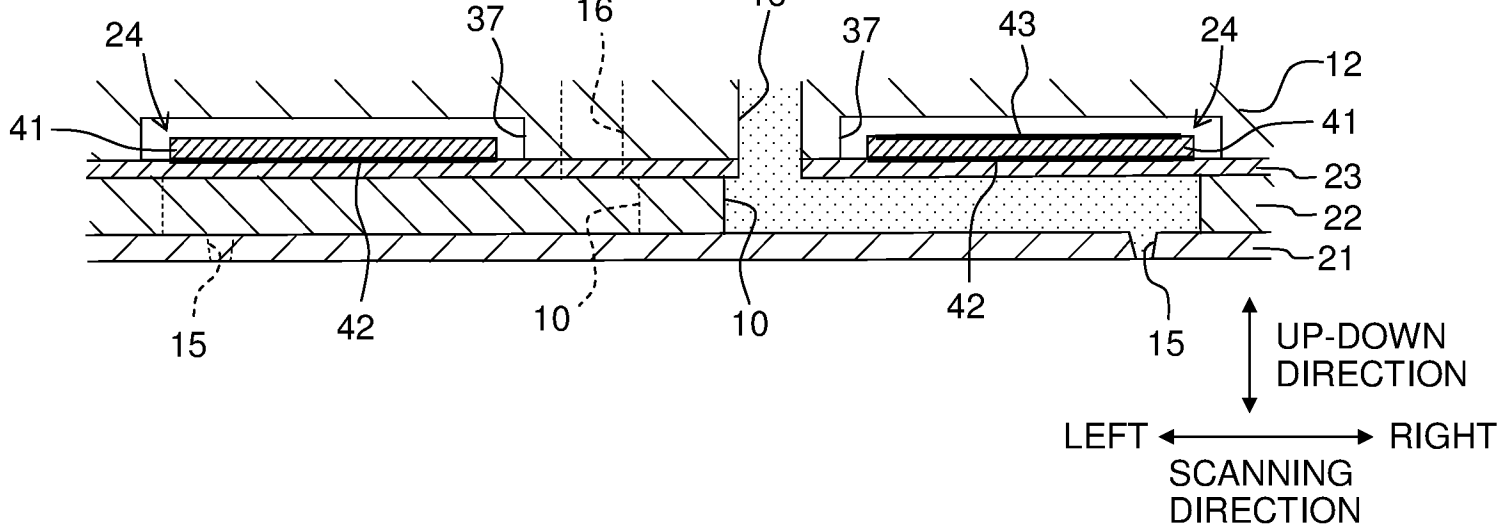
FIG. 7B depicts a sectional view taken along a line VIIB-VIIB in FIG. 6.
Figure 21:
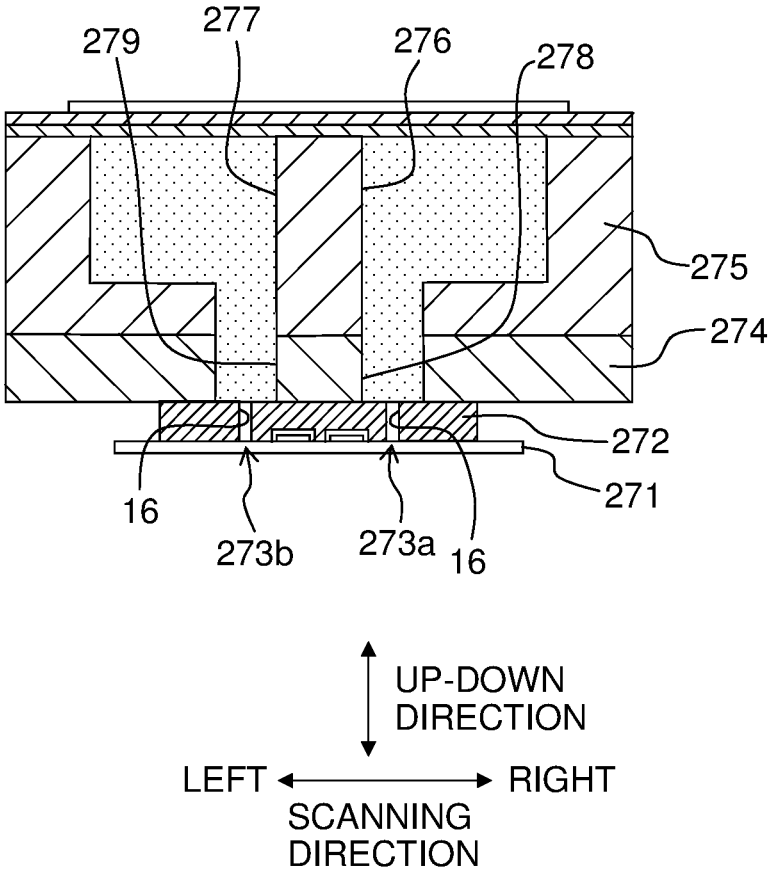
FIG. 21 depicts a sectional view illustrating an ink-jet head according to an eleventh modified embodiment.

Further, in the first and second embodiments, the ink-jet head 3 includes, for example, the four throttle flow passage groups 36*a* to 36*d* and the manifold flow passages 61 to 64 which are aligned in the scanning direction. However, there is no limitation thereto. In an eleventh modified embodiment, as depicted in FIG. 21, a head chip 271 is formed with ink flow passages corresponding to the central two arrays of nozzle arrays 31 included in the plurality of nozzle arrays 31 (see FIG. 4) of the first and second embodiments. Further, a support substrate 272 is formed with two throttle flow passage arrays 273*a*, 273*b* formed respectively by the plurality of throttle flow passages 16 corresponding to the ink flow passages.

Further, the second common flow passage member 275 is formed with two manifold flow passages 276, 277 corresponding to the two throttle flow passage arrays 273*a*, 273*b*. Further, the common flow passage members 274, 275 are formed with a connecting flow passage 278 which connects the manifold flow passage 276 and the plurality of throttle flow passages 16 for forming the throttle flow passage array 273*a*, and a connecting flow passage 279 which connects the manifold flow passage 277 and the plurality of throttle flow passages 16 for forming the throttle flow passage array 273*b*. The shapes of the manifold flow passages 276, 277 are the same as or equivalent to those of the manifold flow passages 62, 63 of the first and second embodiments. Further, the shapes of the connecting flow passages 278, 279 are the same as or equivalent to those of the connecting flow passages 67, 68 of the first and second embodiments.

Further, the ink-jet head may be constructed, for example, such that three or five or more nozzle groups, throttle flow passage groups, and manifold flow passages are aligned in the scanning direction.

Further, in the second embodiment, the two head arrays 104*a*, 104*b* are aligned in the transport direction. However, there is no limitation thereto. It is also allowable that the head arrays are aligned in three or more arrays in the transport direction.

In the foregoing description, the exemplary embodiments have been explained, in which the present teaching is applied to the printer which performs the printing by discharging the inks from the nozzles. However, there is no limitation thereto. The present teaching can be also applied to any liquid discharge apparatus other than the printer, for discharging any liquid other than the ink from a nozzle or nozzles.

What is claimed is:

1. A liquid discharge head comprising:
an individual flow passage member in which individual flow passages are formed;
a common flow passage member which is joined to the individual flow passage member in a first direction and in which common flow passages are formed, the common flow passages being connected to the individual flow passages; and
a film which covers the common flow passages,
wherein the individual flow passage member has nozzle groups, pressure chamber groups, and connecting hole groups communicating with the nozzle groups via the pressure chamber groups respectively,
the individual flow passage member has a first surface and a second surface which are both end surfaces in the first direction, the first surface is further from the common flow passage member than the second surface, the nozzle groups are formed on the first surface, the connecting hole groups are formed on the second surface,
the common flow passages correspond to and are connected to the connecting hole groups, respectively,
each of the nozzle groups is formed along a second direction orthogonal to the first direction,
each of the connecting hole groups is formed along the second direction,
each of the common flow passages extends in the second direction and is connected to one of the nozzle groups via one of the connecting hole groups,
the connecting hole groups are arranged in a third direction which is orthogonal to the first direction and which intersects with the second direction,
the common flow passages are arranged in the third direction,
each of the common flow passages penetrates the common flow passage member in the first direction,
the common flow passage member has a third surface and a fourth surface which are both end surfaces in the first direction,
the third surface is in contact with the second surface of the individual flow passage member, and
the fourth surface is opposite to the third surface in the first direction and is covered by the film.

2. The liquid discharge head according to claim 1, wherein the film has liquid introducing ports to introduce liquid into the common flow passages.

3. The liquid discharge head according to claim 2, wherein each of the liquid introducing ports has a length in the second direction which is longer than a length in the third direction.

4. The liquid discharge head according to claim 2, wherein the liquid introducing ports are arranged on both end sides of the common flow passages in the second direction.

5. The liquid discharge head according to claim 2,
wherein the film has a fifth surface and a sixth surface,
the fifth surface is opposite to the sixth surface in the first direction,
the fifth surface is in contact with the common flow passage member, and
a plate is arranged on the sixth surface.

6. The liquid discharge head according to claim 5, wherein the liquid introducing ports are formed in the plate.

7. The liquid discharge head according to claim 6,
wherein through holes are formed in the plate, and
the through holes overlap with the film.

8. The liquid discharge head according to claim 1,
wherein the common flow passages include:
a first common flow passage in which a first ink is stored; and
a second common flow passage in which a second ink different from the first ink is stored.

9. The liquid discharge head according to claim 8, wherein the first common flow passage is larger in volume than the second common flow passage.

10. The liquid discharge head according to claim 8, wherein the first common flow passage is further from a center portion of the common flow passage member than the second common flow passage in the third direction.

11. The liquid discharge head according to claim 1,
wherein the individual flow passage member includes:
a pressure chamber forming member in which pressure chambers of the pressure chamber groups are formed, the pressure chambers corresponding to nozzles of the nozzle groups, arranged between the nozzle groups and the connecting hole groups in the first direction, and communicating with the nozzles and connecting holes of the connecting hole groups, respectively; and
a connecting hole forming member which is arranged between the common flow passage member and the pressure chamber forming member and in which the connecting holes are formed.

12. The liquid discharge head according to claim 11, wherein the connecting hole forming member is composed of silicon.

13. The liquid discharge head according to claim 11, wherein the individual flow passage member has pressure generating elements which cause pressure to be generated in liquid in the pressure chambers.

14. The liquid discharge head according to claim 13, wherein the pressure generating elements overlap with the connecting holes in the third direction, respectively.

15. The liquid discharge head according to claim 13, wherein the pressure generating elements do not overlap with the connecting holes in the third direction, respectively.

* * * * *